US007426361B2

(12) United States Patent
Thompson et al.

(10) Patent No.: US 7,426,361 B2
(45) Date of Patent: Sep. 16, 2008

(54) DEVELOPER MIXING APPARATUS HAVING FOUR RIBBON BLENDERS

(75) Inventors: Paul E. Thompson, Webster, NY (US); Eric C. Stelter, Pittsford, NY (US); Joseph E. Guth, Holley, NY (US)

(73) Assignee: Eastman Kodak Company, Rochester, NY (US)

( * ) Notice: Subject to any disclaimer, the term of this patent is extended or adjusted under 35 U.S.C. 154(b) by 293 days.

(21) Appl. No.: 11/217,916

(22) Filed: Sep. 1, 2005

(65) Prior Publication Data

US 2007/0048023 A1 Mar. 1, 2007

(51) Int. Cl.
*G03G 15/08* (2006.01)

(52) U.S. Cl. ..... 399/254; 399/252; 399/256; 399/258; 399/263

(58) Field of Classification Search ..... 399/252, 399/254, 256, 258, 263
See application file for complete search history.

(56) References Cited

U.S. PATENT DOCUMENTS

| | | | | |
|---|---|---|---|---|
| 2,919,179 | A | | 12/1959 | Wagner |
| 3,413,716 | A | | 12/1968 | Schwertz et al. |
| 3,795,617 | A | | 3/1974 | McCabe |
| 3,795,618 | A | | 3/1974 | Kasper |
| 3,943,887 | A | | 3/1976 | Smith |
| 4,041,901 | A | | 8/1977 | Rarey et al. |
| 4,076,857 | A | | 2/1978 | Kasper et al. |
| 4,146,323 | A | | 3/1979 | Forward et al. |
| 4,473,029 | A | | 9/1984 | Fritz et al. |
| 4,546,060 | A | | 10/1985 | Miskinis et al. |
| 4,602,863 | A | | 7/1986 | Fritz et al. |
| 4,610,068 | A | * | 9/1986 | Schultz ..... 366/320 |
| 4,634,286 | A | | 1/1987 | Pike |
| 4,764,445 | A | | 8/1988 | Miskinis et al. |
| 4,855,206 | A | | 8/1989 | Saha |
| 4,926,790 | A | | 5/1990 | Nash |
| 4,978,997 | A | | 12/1990 | Bell |
| 4,982,238 | A | | 1/1991 | Davidson |
| 4,996,565 | A | | 2/1991 | Herley |
| 5,001,028 | A | | 3/1991 | Mosehauer et al. |
| 5,065,183 | A | | 11/1991 | Morofuji et al. |
| 5,084,735 | A | | 1/1992 | Rimai et al. |
| 5,111,247 | A | | 5/1992 | Nichols |
| 5,189,475 | A | | 2/1993 | Fournia et al. |
| 5,204,721 | A | | 4/1993 | Sharpe |
| 5,257,077 | A | | 10/1993 | Peters, Jr. et al. |
| 5,307,124 | A | | 4/1994 | Stelter |
| 5,339,146 | A | | 8/1994 | Aslam et al. |
| 5,355,199 | A | | 10/1994 | Bray |
| 5,370,961 | A | | 12/1994 | Zaretsky et al. |

(Continued)

FOREIGN PATENT DOCUMENTS

| | | |
|---|---|---|
| JP | 06 208295 | 7/1994 |
| JP | 2005 024799 | 1/2005 |

*Primary Examiner*—David M. Gray
*Assistant Examiner*—Ryan D Walsh
(74) *Attorney, Agent, or Firm*—Donna P. Suchy

(57) ABSTRACT

A developer mixing apparatus, comprising: a housing including a chamber that holds developer; a first ribbon blender disposed within the chamber and elongate along a first longitudinal axis; and, a second ribbon blender disposed within the chamber and elongate along a second longitudinal axis, wherein the first and second ribbon blenders move developer in different directions.

4 Claims, 11 Drawing Sheets

U.S. PATENT DOCUMENTS 5,376,492 A 12/1994 Stelter et al.
5,394,230 A 2/1995 Kaukeinen et al.
5,400,124 A 3/1995 Kass et al.
5,409,791 A 4/1995 Kaukeinen et al.
5,464,698 A 11/1995 Chen et al.
5,489,975 A 2/1996 Kaukeinen et al.
5,506,372 A 4/1996 Guth et al.
5,506,671 A 4/1996 Buts et al.
5,510,881 A 4/1996 Smith et al.
5,512,403 A 4/1996 Tyagi et al.
5,728,496 A 3/1998 Rimai et al.
5,751,432 A 5/1998 Gwaltney
5,804,341 A 9/1998 Bohan et al.
5,807,651 A 9/1998 Rimai et al.
5,821,972 A 10/1998 Mey et al.
5,847,738 A 12/1998 Tutt et al.
5,937,252 A 8/1999 Peters, Jr. et al.
5,948,585 A 9/1999 Gady et al.
5,950,056 A * 9/1999 Hamamichi et al. ..... 399/256
5,956,544 A 9/1999 Stern et al.
5,963,766 A * 10/1999 Okuno et al. ..... 399/256
5,966,576 A 10/1999 Tyagi et al.
5,968,656 A 10/1999 Ezenyilimba et al.
5,985,499 A 11/1999 Guth et al.
6,074,756 A 6/2000 Vreeland et al.
6,121,986 A 9/2000 Regelsberger et al.
6,184,911 B1 2/2001 Tombs
6,224,978 B1 5/2001 Chen et al.
6,228,549 B1 5/2001 Lambert et al.
6,232,026 B1 5/2001 Lambert
6,352,806 B1 3/2002 Dalal
6,377,772 B1 4/2002 Chowdry et al.
6,393,226 B1 5/2002 Charlebois et al.
6,424,364 B2 7/2002 Gundlach et al.
6,510,305 B1 1/2003 Franzen et al.
6,526,247 B2 2/2003 Stelter et al.
6,577,834 B2 * 6/2003 Suzuki ..... 399/256
6,585,406 B2 * 7/2003 Toepper et al. ..... 399/256
6,589,703 B2 7/2003 Stelter et al.
6,671,476 B1 12/2003 Saiki
2002/0168200 A1 11/2002 Stelter et al.
2002/0186988 A1 12/2002 Abramsohn
2003/0091921 A1 5/2003 Stelter et al.
2003/0147661 A1 8/2003 Ogata
2003/0175053 A1 9/2003 Stelter et al.
2005/0123321 A1 6/2005 Buhay-Kettelkamp et al.

* cited by examiner

DEVELOPER MIXING APPARATUS HAVING FOUR RIBBON BLENDERS

FIELD OF THE INVENTION

The invention relates to electrographic printers and apparatus thereof. More specifically, the invention is directed to processes and apparatus for a developer mixer and related methods of mixing as well as to a powder coating apparatus and related methods of mixing.

BACKGROUND

Electrographic printers use a developer mixing apparatus and related processes for mixing the developer or toner used during the printing process. The term "electrographic printer," is intended to encompass electrophotographic printers and copiers that employ dry toner developed on an electrophotographic receiver element, as well as ionographic printers and copiers that do not rely upon an electrophotographic receiver. The electrographic apparatus often incorporates an electromagnetic brush station, to develop the toner to a substrate (an imaging/photoconductive member bearing a latent image), after which the applied toner is transferred onto a sheet and fused thereon. Related prior art can be found in U.S. Pat. Nos. 4,473,029 and 4,546,060, and U.S. Patent Application Nos. 2002/0168200 and 2003/0091921.

U.S. Pat. Nos. 6,526,247 and 6,589,703 and U.S. Patent Application Publication Nos. 2002/0168200; 2003/0091921; and 2003/0175053 provide additional description of magnetic brush technology using a rotating magnetic core for use in electrographic development apparatus. An essential feature of magnetic brush technology using a rotating magnetic core is that the magnetic field in the development zone has a rotating magnetic field vector. U.S. Pat. Nos. 6,526,247 and 6,589,703 and United States Patent Application Publication Nos. 2002/0168200; 2003/0091921; and 2003/0175053 are hereby incorporated by reference as if fully set forth herein.

U.S. Pat. Nos. 4,473,029; 4,546,060; and 4,602,863 provide a description of magnetic brush technology using a rotating magnetic core for use in electrographic development apparatus. U.S. Pat. Nos. 4,473,029; 4,546,060; and 4,602,863, and U.S. Patent Application Publication Nos. 2002/0168200 and 2003/0091921 are hereby incorporated by reference as if fully set forth herein.

U.S. Pat. No. 5,400,124 provides a description of magnetic brush technology using a rotating magnetic core and a stationary toning shell for applying toner to an electrostatic image. U.S. Pat. No. 5,966,576 provides a description of an alternate configuration of toning station also having rotating magnetic field vectors, in which a plurality of rotatable magnets are located adjacent to the underside of the development surface of the applicator sleeve to move developer material through the development zone. U.S. Pat. No. 5,376,492 discusses development using a rotating magnetic core and an AC developer bias.

U.S. Pat. Nos. 5,400,124; 5,966,576; and 5,376,492 are hereby full incorporated by reference as if fully set forth herein.

U.S. Pat. No. 5,307,124 discusses pre-charging toner before feeding into the developer sump containing partially depleted two-component developer material. U.S. Pat. No. 5,506,372 discusses a development station having a particle removal device for removing aged magnetic carrier to compensate for the addition of fresh carrier.

Depositing multiple layers of toner on a substrate by direct deposition from a magnetic brush includes U.S. Pat. Nos. 5,001,028 and 5,394,230, which discuss a process for producing two or more toner images in a single frame or area of an image member using two or more magnetic brush development stations with rotating magnetic cores. In this process, a region of an electrostatic receiver is developed with a first toner of a first polarity and then the receiver with a deposit of charged toner particles is passed through a second magnetic brush using a second toner of the first polarity, which deposits the second toner on the receiver. U.S. Pat. Nos. 5,409,791; 5,489,975; and 5,985,499 discuss a process for developing an electrostatic image on an image member already containing a loose dry first toner image with a second toner having the same electrical polarity as the first toner, using rotating magnetic core technology and AC projection toning, where the developer nap is not in contact with the receiver. U.S. Pat. Nos. 5,307,124; 5,506,372; 5,001,028; 5,394,230; 5,409,791; 5,489,975; and 5,985,499 are hereby incorporated by reference as if fully set forth herein.

For depositing multiple layers of toner on a substrate by transfer of the toner from an intermediate transfer member, intermediate transfer medium, or ITM, U.S. Pat. No. 5,084,735 and U.S. Pat. No. 5,370,961 disclose use of a compliant ITM roller coated by a thick compliant layer and a relatively thin hard overcoat to improve the quality of electrostatic toner transfer from an imaging member to a receiver, as compared to a non-compliant intermediate roller. Additional applications of hard overcoats on intermediate transfer members are disclosed in U.S. Pat. Nos. 5,728,496 and 5,807,651, which describe an overcoated photoconductor and overcoated transfer member, U.S. Pat. No. 6,377,772, which describes composite intermediate transfer members, and U.S. Pat. No. 6,393,226, which describes an intermediate transfer member having a stiffening layer. U.S. Pat. Nos. 5,084,735; 5,370,961; 5,728,496; 5,807,651; 6,377,772; and 6,393,226 are hereby incorporated by reference as if fully set forth herein.

U.S. Pat. No. 6,608,641 describes a printer for printing color toner images on a receiver member of any of a variety of textures. The printer has a number of electrophotographic image-forming modules arranged in tandem (see for example, Tombs, U.S. Pat. No. 6,184,911). These include a plurality of imaging subsystems to form a colored toner image that is transferred to a receiver member, the transfer of toner images from each of the modules forming a color print on the receiver member which is fused to form a desired color print. U.S. Pat. Nos. 6,608,641 and 6,184,911 are hereby incorporated by reference as if fully set forth herein.

Such a printer includes two or more single-color image forming stations or modules arranged in tandem and an insulating transport web for moving receiver members such as paper sheets through the image forming stations, wherein a single-color toner image is transferred from an image carrier, i.e., a photoconductor (PC) or an intermediate transfer member (ITM), to a receiver held electrostatically or mechanically to the transport web, and the single-color toner images from each of the two or more single-color image forming stations are successively laid down one upon the other to produce a plural or multicolor toner image on the receiver.

As is well known, a toner image may be formed on a photoconductor by the sequential steps of uniformly charging the photoconductor surface in a charging station using a corona charger, exposing the charged photoconductor to a pattern of light in an exposure station to form a latent electrostatic image, and toning the latent electrostatic image in a development station to form a toner image on the photoconductor surface. The toner image may then be transferred in a transfer station directly to a receiver, e.g., a paper sheet, or it may first be transferred to an ITM and subsequently transferred to the receiver. The toned receiver is then moved to a fusing station where the toner image is fused to the receiver by heat and/or pressure.

In a digital electrophotographic copier or printer, a uniformly charged photoconductor surface may be exposed pixel by pixel using an electro-optical exposure device comprising light emitting diodes, such as for example described by Y. S. Ng et al., Imaging Science and Technology, 47th Annual Conference Proceedings (1994), pp. 622-625.

A widely practiced method of improving toner transfer is by use of so-called surface treated toners. As is well known, surface treated toner particles have adhered to their surfaces sub-micron particles, e.g., of silica, alumina, titania, and the like (so-called surface additives or surface additive particles). Surface treated toners generally have weaker adhesion to a smooth surface than untreated toners, and therefore surface treated toners can be electrostatically transferred more efficiently from a PC or an ITM to another member.

As disclosed in the Rimai et al. patent (U.S. Pat. No. 5,084,735), in the Zaretsky and Gomes patent (U.S. Pat. No. 5,370,961) and in subsequent U.S. Pat. Nos. 5,821,972; 5,948,585; 5,968,656; 6,074,756; 6,377,772; 6,393,226; and 6,608,641, use of a compliant ITM roller coated by a thick compliant layer and a relatively thin hard overcoat improves the quality of electrostatic toner transfer from an imaging member to a receiver, as compared to a non-compliant intermediate roller. U.S. Pat. Nos. 5,084,735; 5,370,961; 5,728,496; 5,807,651; 5,821,972; 5,948,585; 5,968,656; 6,074,756; 6,377,772; 6,393,226; and 6,608,641 are hereby incorporated by reference as if fully set forth herein.

A receiver carrying an unfused toner image may be fused in a fusing station in which a receiver carrying a toner image is passed through a nip formed by a heated compliant fuser roller in pressure contact with a hard pressure roller. Compliant fuser rollers are well known in the art. For example, the Chen et al. patent (U.S. Pat. No. 5,464,698) discloses a toner fuser member having a silicone rubber cushion layer disposed on a metallic core member, and overlying the cushion layer, a layer of a cured fluorocarbon polymer in which is dispersed a particulate filler. Also, in the Chen et al. U.S. Pat. No. 6,224,978 is disclosed an improved compliant fuser roller including three concentric layers, each of which layers includes a particulate filler. Additional fusing means known in the art, such as non-contact fusing using IR radiation, oven fusing, or fusing by vapors may also be used. U.S. Pat. Nos. 5,464,698 and 6,224,978 are hereby incorporated by reference as if fully set forth herein.

U.S. Pat. Nos. 5,339,146; 5,506,671; 5,751,432; and 6,352,806 discuss means of forming overcoats on receivers with charged particles in the context of electrographic imaging. U.S. Pat. No. 5,339,146 uses a fusing surface or belt as an intermediate transfer member. This patent discloses mixing a clear particulate material with a magnetic carrier. The clear particulate material is applied using an applicator of a conventional magnetic brush development device. The applicator, using a rotating magnetic core and/or a rotatable shell, moves the developer mixture through contact with the fusing surface to deposit the particulate material on it. An electrical field is applied between the applicator and belt to assist this application. The fusing belt is preferably a metal belt with a smooth hard surface. U.S. Pat. No. 5,506,671 discloses an electrostatographic printing process for forming one or more colorless toner images in combination with at least one color toner image. At each image-producing station an electrostatic latent image is formed on a rotatable endless surface; toner is deposited on the electrostatic latent image to form a toner image on the rotatable surface, and the toner image is transferred from its corresponding rotatable surface onto the receptor element. U.S. Pat. No. 5,751,432 is directed to glossing selected areas of an imaged substrate and, in particular, to creating images, portions of which include clear polymer for causing them to exhibit high gloss thereby causing them to be highlighted. The clear toner may be applied to color toner image areas as well as black image areas. Additionally, the clear toner may be applied to non-imaged areas of the substrate. In carrying out the invention, a fifth developer housing is provided in a color image creation apparatus normally including only four developer housings. U.S. Pat. No. 6,352,806 concerns a color image reproduction machine that includes means for forming an additional toner image using clear colorless toner particles, thereby resulting in a uniform gloss of the full-gamut color toner image.

Additional prior art for electrostatically applied overcoats on images produced by non-electrographic means include: U.S. Pat. No. 5,804,341, which concerns an electrostatically applied overcoat on a silver halide image; U.S. Pat. No. 5,847,738, in which an electrostatic overcoat is applied to liquid ink; and U.S. Pat. No. 6,031,556, which cites an electrostatic overcoat on an image produced by thermal transfer. U.S. Pat. No. 6,424,364 cites use of an electrostatically-applied clear polymer as an undercoat to capture ink jet images which are subsequently fused.

Transfer of charged toner particles to metal substrates, particularly copper or zinc printing plates, from a paper intermediate using electrostatic transfer is disclosed by Sinclair, M., in Printing Equip. Engr. November 1948, p. 21-25.

The toner was used as an acid resist for etching. Transfer of charged toner particles to metal substrates from an intermediate using adhesive transfer is disclosed in: Ullrich O. A., Walkup, L. E., and Russel, R. E., Proc. Tech. Assn. Graphic Arts p. 130-138 (1954). The toner was used as an ink-bearing surface.

Other prior art citing functional uses of toner include U.S. Pat. No. 2,919,179 which discusses using toner transferred directly from a photoconductor to a metallic surface for use as an etch resist. Although several distinct applications are discussed, the description is limited, by way of example, to the discussion of printed circuit boards. U.S. Pat. No. 3,413,716 discloses transfer of toner particles from a photoconductor to a metallic surface to form a resist layer for etching inductors. U.S. Pat. Nos. 2,919,179 and 3,413,716 are hereby incorporated by reference as if fully set forth herein.

Ribbon blenders are used in two-component toning stations. An example of a two-ribbon blender assembly is presented in U.S. Pat. No. 4,634,286 the contents of which are hereby incorporated by reference as if fully set forth herein. As described in that patent, the outer ribbon moves developer material toward the center of the toning station. The inner ribbon moves developer material from the center toward the ends of the toning station. This produces good mixing between inward-flowing and outward-flowing material.

The present invention corrects the imbalances which can occur in inward and outward flow, thereby leading to non-uniform toner deposition on the substrate. The apparatus and related methods keep the different types of developers mixed and transported efficiently as needed, maintaining the correct proportions necessary to produce the high quality prints or powder coatings required by consumer demand. The following invention solves the current problems with developer mixing so that the mixer will work in a wide variety of situations.

SUMMARY OF THE INVENTION

The invention is in the field of mixing apparatus and processes for an electrographic printer and powder coating systems. More specifically, the invention relates to a mixing apparatus and processes that implement mixing in a plurality of directions. The mixing apparatus has a housing with a chamber that holds developer and a first ribbon blender disposed within the chamber and elongate along a first longitudinal axis and a second blender disposed within the same chamber and elongate along a second longitudinal axis. The first ribbon blender has an intermediate portion and marginal portions spaced from each other along the longitudinal axis on either side of the intermediate portion.

DETAILED DESCRIPTION

Figure 1:
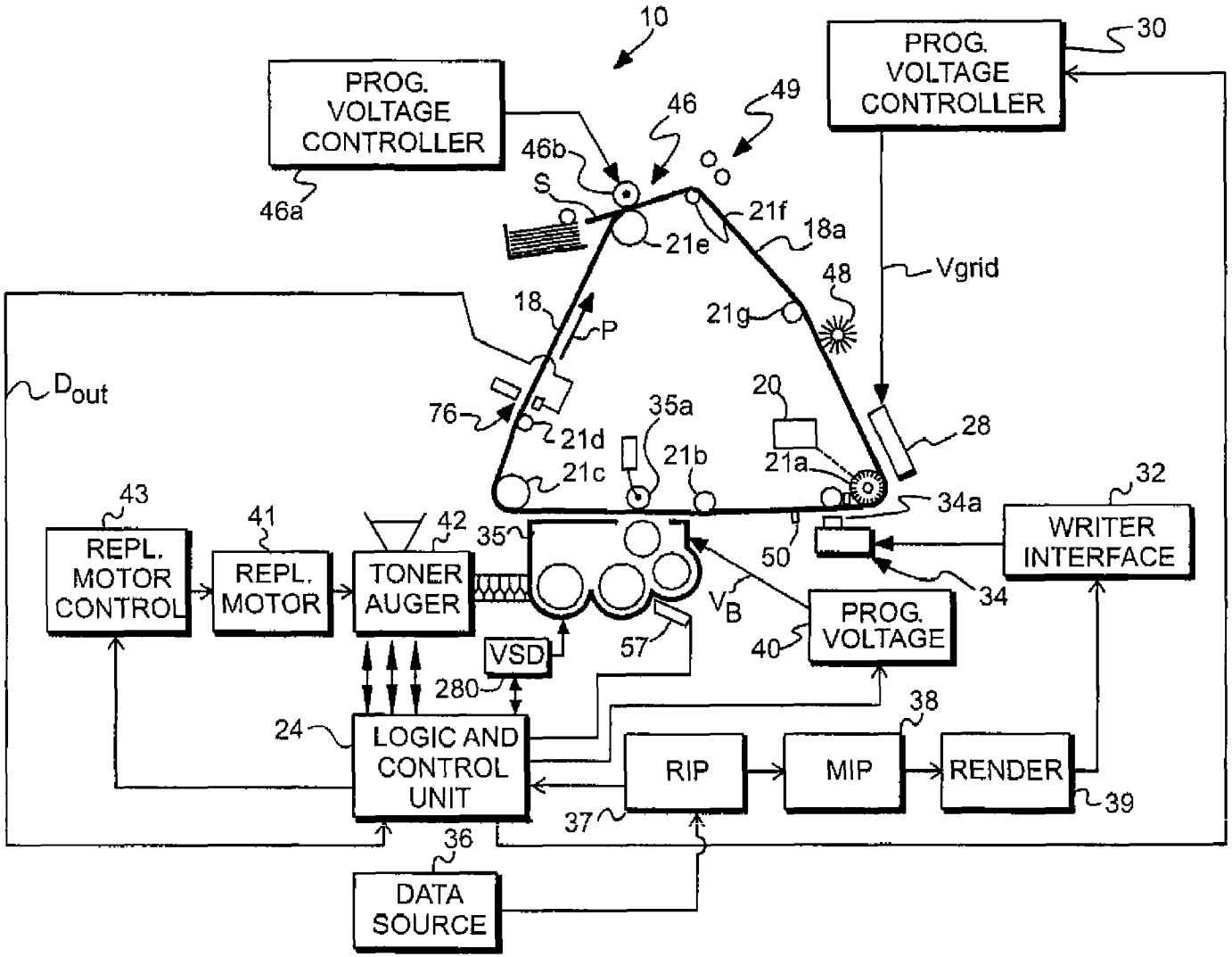
FIG. 1 presents a schematic view of a printer machine according to one aspect of the invention.

Various aspects of the invention are presented with reference to FIGS. 1-9, which are not drawn to any particular scale, and wherein like components in the numerous views are numbered alike. Referring now specifically to FIG. 1, a printer machine 10, such as an electrophotographic printer, that implements the electrographic developer mixing apparatus and processes of the invention is presented. The printer machine 10 includes a moving electrographic imaging or receiver member 18 such as a photoconductive belt which is entrained about a plurality of rollers or other supports 21*a* through 21*g*, one or more of which is driven by a motor to advance the belt. By way of example, roller 21*a* is illustrated as being driven by motor 20. Motor 20 preferably advances the belt at a high speed, such as 20 inches per second or higher, in the direction indicated by arrow P, past a series of workstations of the printer machine 10. Alternatively, belt 18 may be wrapped and secured about only a single drum, or may be a drum.

The term "electrographic printer," is intended to encompass electrophotographic printers and copiers that employ dry toner developed on an electrographic receiver element, as well as ionographic printers and copiers that do not rely upon an electrographic receiver. The processes of the present invention may also include a powder applicator for applying powder materials. To this end, reference is hereby made to copending U.S. application Ser. No. 11/075,784 entitled POWDER COATING APPARATUS AND METHOD OF POWDER COATING USING AN ELECTROMAGNETIC BRUSH, filed on Mar. 9, 2005, the contents of which are incorporated by reference as if fully set forth herein.

Printer machine 10 includes a controller or logic and control unit (LCU) 24, preferably a digital computer or microprocessor operating according to a stored program for sequentially actuating the workstations within printer machine 10, effecting overall control of printer machine 10 and its various subsystems. LCU 24 also is programmed to provide closed-loop control of printer machine 10 in response to signals from various sensors and encoders. Aspects of process control are described in U.S. Pat. No. 6,121,986 incorporated herein by this reference.

A primary charging station 28 in printer machine 10 sensitizes belt 18 by applying a uniform electrostatic corona charge, from high-voltage charging wires at a predetermined primary voltage, to a surface 18*a* of belt 18. The output of charging station 28 is regulated by programmable voltage controller 30, which is in turn controlled by LCU 24 to adjust this primary voltage, for example by controlling the electrical potential of a grid and thus controlling movement of the corona charge. Other forms of chargers, including brush or roller chargers, may also be used.

An exposure station 34 in printer machine 10 projects light from a writer 34*a* to belt 18 in accordance with parameters supplied from a writer interface 32. This light selectively dissipates the electrostatic charge on photoconductive belt 18 to form a latent electrostatic image of the document to be copied or printed. Writer 34*a* is preferably constructed as an array of light emitting diodes (LEDs), or alternatively as another light source such as a laser or spatial light modulator. Writer 34*a* exposes individual picture elements (pixels) of belt 18 with light at a regulated intensity and exposure, in the manner described below. After exposure, the portion of the belt bearing the latent charge image travels to a development station 35, which can apply toner to the belt 18 by moving a backup roller or bar 35*a*, which will be discussed in more detail below. The exposing light discharges selected pixel locations of the photoconductor, so that the pattern of localized voltages across the photoconductor corresponds to the image to be printed. An image is a pattern of physical light which may include characters, words, text, and other features such as graphics, photos, etc. An image may be included in a set of one or more images, such as in images of the pages of a document. An image may be divided into segments, objects, or structures each of which is itself an image. A segment, object or structure of an image may be of any size up to and including the whole image.

Image data to be printed is provided by an image data source 36, which is a device that can provide digital data defining a version of the image. Such types of devices are numerous and include computer or microcontroller, computer workstation, scanner, digital camera, etc. These data represent the location and intensity of each pixel that is exposed by the printer. Signals from image data source 36, in combination with control signals from LCU 24 are provided to a raster image processor (RIP) 37. The digital images (including styled text) are converted by the RIP 37 from their form in a page description language (PDL) to a sequence of serial instructions for the electrographic printer in a process commonly known as "ripping" and which provides a ripped image to an image storage and retrieval system known as a Marking Image Processor (MIP) 38.

In general, the major roles of the RIP 37 are to: receive job information from the server; parse the header from the print job and determine the printing and finishing requirements of the job; analyze the PDL (Page Description Language) to reflect any job or page requirements that were not stated in the header; resolve any conflicts between the requirements of the job and the Marking Engine configuration (i.e., RIP time mismatch resolution); keep accounting record and error logs and provide this information to any subsystem, upon request; communicate image transfer requirements to the Marking Engine; translate the data from PDL (Page Description Language) to Raster for printing; and support diagnostics communication between User Applications. The RIP accepts a print job in the form of a Page Description Language (PDL) such as PostScript, PDF or PCL and converts it into Raster, a form that the marking engine can accept. The PDL file received at the RIP describes the layout of the document as it was created on the host computer used by the customer. This conversion process is called rasterization. The RIP makes the decision on how to process the document based on what PDL the document is described in. It reaches this decision by looking at the first 2 K of the document. A job manager sends the job information to a MSS (Marking Subsystem Services) via Ethernet and the rest of the document further into the RIP to get rasterized. For clarification, the document header contains printer-specific information such as whether to staple or duplex the job. Once the document has been converted to raster by one of the interpreters, the Raster data goes to the MIP 38 via RTS (Raster Transfer Services); this transfers the data over an IDB (Image Data Bus).

The MIP functionally replaces recirculating feeders on optical copiers. This means that images are not mechanically rescanned within jobs that require rescanning, but rather, images are electronically retrieved from the MIP to replace the rescan process. The MIP accepts digital image input and stores it for a limited time so it can be retrieved and printed to complete the job as needed. The MIP consists of memory for storing digital image input received from the RIP. Once the images are in MIP memory, they can be repeatedly read from memory and output to an image render circuit 39. Compressing the images can reduce the amount of memory required to store a given number of images; therefore, the images are compressed prior to MIP memory storage, and then decompressed while being read from MIP memory.

The output of the MIP is provided to the image render circuit 39, which alters the image and provides the altered image to the writer interface 32 (otherwise known as a write head, print head, etc.) which applies exposure parameters to the exposure medium, such as a photoconductor 18.

After exposure, the portion of exposure medium belt 18 bearing the latent charge images travels to a development station 35. Development station 35 includes a magnetic brush in juxtaposition to the belt 18. Magnetic brush development stations are well known in the art, and are preferred in many applications. Alternatively, other known types of development stations or devices may be used. Development stations apply marking material onto the electrographic receiver or belt 18. The marking material may be comprised of a number of materials, such as toner, powder, etc. For exemplary purposes, the term toner will be used henceforth to describe the marking material. Plural development stations 35 may be provided for developing images in plural colors, or from toners of different physical characteristics. Full process color electrographic printing is accomplished by utilizing this process for each of four toner colors (e.g., black, cyan, magenta, yellow).

When the imaged portion of the electrographic receiver, or belt 18, reaches the development station 35, the LCU 24 selectively activates the development station 35 to apply toner to belt 18 by moving the backup roller or bar 35*a* against the belt 18, into engagement with or close proximity to the magnetic brush. Alternatively, the magnetic brush may be moved toward belt 18 to selectively engage belt 18. In either case, charged toner particles on the magnetic brush are selectively attracted to the latent image patterns present on belt 18, developing those image patterns. As the exposed photoconductor passes the developing station, toner is attracted to pixel locations of the photoconductor and as a result, a pattern of toner corresponding to the image to be printed appears on the photoconductive belt 18, thereby forming a developed image on the electrostatic image. As known in the art, conductor portions of development station 35, such as conductive applicator cylinders, are biased to act as electrodes. The electrodes are connected to a variable supply voltage, which is regulated a by programmable controller 40 in response to the LCU 24, there by controlling the development process.

Development station 35 may contain a two-component developer mix including a dry mixture of toner or powder and carrier particles. Typically the carrier preferably has high coercivity (hard magnetic) ferrite particles. As an example, the carrier particles have a volume-weighted diameter of approximately 26μ. The dry toner particles are substantially smaller, on the order of 6μ to 15μ in volume-weighted diameter. Development station 35 may include an applicator having a magnetic core within a shell, either of which may be rotatably driven by a motor or other suitable driving means. Relative rotation of the core and shell moves the developer through a development zone in the presence of an electrical field. In the course of development, the toner selectively electrostatically adheres to photoconductive belt 18 to develop the electrostatic images thereon and the carrier material remains at development station 35. As toner is depleted from the development station due to the development of the electrostatic image. Additional toner is periodically introduced by a toner replenisher 42 driven by a replenisher motor 41 into development station 35 in response to a replenisher motor control 43. The toner is mixed with the carrier particles to maintain a uniform amount of development mixture. This development mixture is controlled in accordance with various development control processes that use information gathered from various devices, such as a toner concentration monitors 57. Single component developer stations, as well as conventional liquid toner development stations, may also be used.

A transfer station 46 in printing machine 10, including a programmable voltage controller 46*a* and roller 46*b*, moves a receiver (such as a sheet S) into engagement with photoconductive belt 18, in registration with a developed image to transfer the developed image to receiver S. Receiver S may be plain or coated paper, plastic, or another medium capable of being handled by printer machine 10, such as a sheet, web, roll, or intermediate for intermediate transfer. Typically, transfer station 46 includes a charging device for electrostatically biasing movement of the toner particles from belt 18 to receiver sheet S. In this example, the biasing device is roller 46*b*, which engages the back of the receiver S and which is connected to programmable voltage controller 46*a* that operates in a constant current mode during transfer. Alternatively, an intermediate member may have the image transferred to it and the image may then be transferred to a receiver. After transfer of the toner image to a receivers, it is detacked from belt 18 and transported to fuser station 49 where the image is fixed onto the receiver, typically by the application of heat. Alternatively, the image may be fixed to the receiver at the time of transfer. A fuser entry guide may be implemented between the transfer station 46 and the fuser station, for example, as described in U.S. patent application Ser. No. 10/668,416 filed Sep. 23, 2003, in the names of John Giannetti, Giovanni B. Caiazza, and Jerome F. Sleve, the contents of which are incorporated by reference as if fully set forth herein.

A cleaning station 48, such as a brush, blade, or web is also located adjacent belt 18 behind transfer station 46, and removes residual toner from belt 18. A pre-clean charger (not shown) may be located before or at cleaning station 48 to assist in this cleaning. After cleaning, this portion of belt 18 is then ready for recharging and re-exposure. Of course, other portions of belt 18 are simultaneously located at the various workstations of printing machine 10, so that the printing process is carried out in a substantially continuous manner.

LCU 24 provides overall control of the apparatus and its various subsystems as is well known. LCU 24 will typically include temporary data storage memory, a central processing unit, timing and cycle control unit, and stored program control. Data input and output is performed sequentially through or under program control. Input data can be applied through input signal buffers to an input data processor, or through an interrupt signal processor, and include input signals from various switches, sensors, and analog-to-digital converters internal to printing machine 10, or received from sources external to printing machine 10, such from as a human user or a network control. The output data and control signals from LCU 24 are applied directly or through storage latches to suitable output drivers and in turn to the appropriate subsystems within printing machine 10.

Process control strategies generally utilize various sensors to provide real-time closed-loop control of the electrostatographic process so that printing machine 10 generates "constant" image quality output, from the user's perspective. Real-time process control is necessary in electrographic printing, to account for changes in the environmental ambient of the electrographic printer, and for changes in the operating conditions of the printer that occur over time during operation (rest/run effects). An important environmental condition parameter requiring process control is relative humidity, because changes in relative humidity affect the charge-to-mass ratio Q/m of toner particles. The ratio Q/m directly determines the density of toner that adheres to the photoconductor during development, and thus directly affects the density of the resulting image. An example of charges in operating conditions include system changes that can occur over time include changes due to aging of the printhead (exposure station), changes in the concentration of magnetic carrier particles to the toner as the toner is depleted through use, changes in the mechanical position of primary charger elements, aging of the electrographic receiver, variability in the manufacture of electrical components and of the electrographic receiver, change in conditions as the printer warms up after power-on, triboelectric charging of the toner, and other changes in electrographic process conditions. Because of these effects and the high resolution of modern electrographic printing, the process control techniques have become quite complex.

One process control sensor used is a densitometer 76, which monitors test patches that are exposed and developed in non-image areas of the photoconductive belt 18 under the control of LCU 24. Densitometer 76 may include an infrared or visible light LED, which either shines through the belt or is reflected by the belt onto a photodiode in densitometer 76. These developed test patches are exposed to varying toner density levels, including full density and various intermediate densities, so that the actual density of toner in the patch can be compared with the desired density of toner as indicated by the various control voltages and signals. These densitometer measurements are used to control primary charging voltage $V_O$, maximum exposure light intensity $E_O$, and development station electrode bias $V_B$. In addition, the process control utilizes a toner replenishment control signal value or a toner concentration set point value to maintain the charge-to-mass ratio Q/m at a level that avoids dusting or hollow character formation due to low toner charge, and also avoids breakdown and transfer mottle due to high toner charge for improved accuracy in the process control of printing machine 10. The developed test patches are formed in the interframe area of belt 18 so that the process control can be carried out in real time without reducing the printed output throughput. Another sensor useful for monitoring process parameters in printer machine 10 is electrometer probe 50, mounted downstream of the charging station 28 relative to direction P of the movement of belt 18. An example of an electrometer is described in U.S. Pat. No. 5,956,544 incorporated herein by this reference.

Other approaches to electrographic printing process control may be utilized, such as those described in International Publication Number WO 02/10860 A1, and International Publication Number WO 02/14957 A1, both commonly assigned herewith and incorporated herein by this reference.

Raster image processing begins with a page description generated by the computer application used to produce the desired image. The Raster Image Processor interprets this page description into a display list of objects. This display list contains a descriptor for each text and non-text object to be printed; in the case of text, the descriptor specifies each text character, its font, and its location on the page. For example, the contents of a word processing document with styled text is translated by the RIP into serial printer instructions that include, for the example of a binary black printer, a bit for each pixel location indicating whether that pixel is to be black or white. Binary print means an image is converted to a digital array of pixels, each pixel having a value assigned to it, and wherein the digital value of every pixel is represented by only two possible numbers, either a one or a zero. The digital image in such a case is known as a binary image. Multi-bit images, alternatively, are represented by a digital array of pixels, wherein the pixels have assigned values of more than two number possibilities. The RIP renders the display list into a "contone" (continuous tone) byte map for the page to be printed. This contone byte map represents each pixel location on the page to be printed by a density level (typically eight bits, or one byte, for a byte map rendering) for each color to be printed. Black text is generally represented by a full density value (255, for an eight bit rendering) for each pixel within the character. The byte map typically contains more information than can be used by the printer. Finally, the RIP rasterizes the byte map into a bit map for use by the printer. Half-tone densities are formed by the application of a halftone "screen" to the byte map, especially in the case of image objects to be printed. Pre-press adjustments can include the selection of the particular halftone screens to be applied, for example to adjust the contrast of the resulting image.

Electrographic printers with gray scale printheads are also known, as described in International Publication Number WO 01/89194 A2, incorporated herein by this reference. As described in this publication, the rendering algorithm groups adjacent pixels into sets of adjacent cells, each cell corresponding to a halftone dot of the image to be printed. The gray tones are printed by increasing the level of exposure of each pixel in the cell, by increasing the duration by way of which a corresponding LED in the printhead is kept on, and by "growing" the exposure into adjacent pixels within the cell.

Ripping is printer-specific, in that the writing characteristics of the printer to be used are taken into account in producing the printer bit map. For example, the resolution of the printer both in pixel size (dpi) and contrast resolution (bit depth at the contone byte map) will determine the contone byte map. As noted above, the contrast performance of the printer can be used in pre-press to select the appropriate halftone screen. RIP rendering therefore incorporates the attributes of the printer itself with the image data to be printed.

The printer specificity in the RIP output may cause problems if the RIP output is forwarded to a different electrographic printer. One such problem is that the printed image will turn out to be either darker or lighter than that which would be printed on the printer for which the original RIP was performed. In some cases the original image data is not available for re-processing by another RIP in which tonal adjustments for the new printer may be made.

Similarly, according to the invention, the powder particles are developed, although preferably directly deposited as described above in connection with FIGS. 1 and 2, to a substrate on which the final coating is subsequently fixed.

Toner or powder for use in the invention is, broadly, electrostatically chargeable powder for electrostatic coating systems, monocomponent development systems, or two-component development systems.

Toner or powder particles are polymeric or resin-based. Although thermoplastic resins are useable, thermosetting powders are more preferred. In two-component development, the toner/powder is mixed with magnetic carrier particles to form the developer, as explained above.

The powder/toner particles are created by blending various components, which can include binders, resins, pigments, fillers, and additives, for example, and processing the components by heating and milling, for example, whereupon a homogeneous mass is dispensed by an extruder. The mass is then cooled, crushed into small chips or lumps, and then ground into a powder.

The aforementioned additives incorporated within the powder particles can includes one or more of charge agents for tribo-charging, flow aids for curing/fixing, cross-linkers to build up multiple chains, and catalysts to change the degree of cross-linking by initiating polymerization. Pigments can also be added to create a desired decorative effect. It is also contemplated to provide a powder in the form of a clear coat.

According to the invention the components that make up the powder particles are ground/pulverized to make a powder with a particle size ranging from 5 microns to 50 microns, not necessarily the same as the initial particle size. The invention is particularly useful with small powder particles having a diameter of less than 20 microns and, preferably, less than 12 microns, thereby resulting in coating layers that have fewer, or substantially no pinholes, after curing.

U.S. Pat. No. 4,546,060, disclosed for the use in the field of electrography for the development of electrostatic images, discloses toner in the form of a powdered resin and processes for manufacturing such toner. Other suitable examples of toner/powder compositions are disclosed in U.S. Pat. Nos. 4,041,901; 5,065,183; and 6,342,273.

Still further, another exemplary disclosure of powder particles, their composition and manufacture, which can be used according to the invention, is provided in Complete Guide to Powder Coatings (Issue 1-November 1999) of Akzo Nobel.

The toner Q/m ratio is measured in a MECCA device comprised of two spaced-apart, parallel, electrode plates to which both a DC electric field and an oscillating magnetic field is applied to the developer samples, thereby causing a separation of the two components of the mixture, i.e., hard ferrite carrier and powder paint particles. Typically, a 0.100 g sample of a developer mixture is placed on the bottom metal plate. The sample is then subjected for thirty (30) seconds to a 60 Hz magnetic field and potential of 2500 V across the plates, which causes developer agitation. The powder paint particles are released from the carrier particles under the combined influence of the magnetic and electric fields and are attracted to and thereby deposit on the upper electrode plate, while the magnetic carrier particles are held on the lower plate. An electrometer measures the accumulated charge of the powder on the upper plate. The powder paint Q/m ratio in terms of microcoulombs per gram (μC/g) is calculated by dividing the accumulated charge by the mass of the deposited powder taken from the upper plate.

The performance of the toners and powder paint developers is determined using an electrographic breadboard device as described in U.S. Pat. No. 4,473,029, the teaching of which have been previously incorporated herein in their entirety. The device has two electrostatic probes, one before a magnetic brush development station and one after the station to measure the voltage on the substrate before and after coating. The substrate (e.g., aluminum, carbon steel, stainless steel, copper) is attached (with electrical continuity) to a traveling platen. The substrate is held at ground, while the magnetic brush applicator shell is biased according to the polarity of the powder paint. For example, a negatively charged powder paint would require a negative bias on the shell to propel the particles away from the developer on the shell to the grounded support. The shell and substrate are set at a spacing of 0.020 inches, the core is rotated clockwise at 1500 rpm, and the shell is rotated at 15 rpm counter-clockwise. The substrate platen was set to travel at a speed of 3 inches per second. The nap density on the development roller was ~0.5 g/in 2. After coating, the substrate was heated in an oven to cure the thermosetting powder.

Paints, or resin-based coatings, are normally applied as liquids by roller, brush, or spray. There are advantages in using dry paint powders for coating, particularly in the elimination of solvents. Dry paints are normally applied by electrostatic spray to a grounded object. In powder spray coating, the charging of the powder is achieved by corona or friction, with minimal compositional assistance. For optimal efficiency, spray gun techniques require particle sizes in the 35-100μ mean volume diameter to optimize charging and minimize fines losses. Unfortunately, dry powder coating by electrostatic spray gun is at least an order of magnitude lower in throughput (coating speed) than liquid application on coil or flat substrates. It is to be noted that smaller particles are difficult to apply with dry gun techniques.

An alternative dry application technique is electrostatic development of a powder from a hard ferrite developer in a rotating magnetic brush applicator station. This technique, in combination with high speed curing, can exceed the coating speed of liquid paint systems, without the environmental impact and costs associated with solvent. The material requirements for the powder in this system are significantly different than those of the electrostatic spray gun.

To compete with liquid paint coating for throughput, dry powder coating by rotating magnet applicator needs to deliver powder at least 2x the maximum density laydown of an electrophotographic printer, and at "page" laydowns that are 10 to 100x higher. To perform satisfactorily in a rotating magnet powder paint applicator, the powder must flow without packing, be easily charged, and triboelectrically stable. Adequate flow is needed to move the large mass of powder through a delivery system (replenisher) into the applicator sump, and then subsequently allow sufficient mixing within the sump for charging and uniformity.

Ideally, a rotating powder paint developer should maintain a constant, and low tribocharge (of either polarity) to maximize laydown capacity and uniformity. To achieve this performance, a combination of materials is required. Charge agents are required to adjust charge level and/or stability. Surface treatment is usually employed to manage flow and delivery of the powder paint to and in the applicator mixing sump. Our results show that the level of surface treatment also interacts with the charge agent and powder particle size to determine the charge level and stability in these rotating magnet powder paints. Toner or powder for use in the invention is, broadly, electrostatically chargeable powder for electrostatic coating systems, monocomponent development systems, or two-component development systems.

Toner or powder particles are polymeric or resin-based. Although thermoplastic resins are useable, thermosetting powders are more preferred. In two-component development, the toner/powder is mixed with magnetic carrier particles to form the developer, as explained above.

The powder/toner particles are created by blending various components, which can include binders, resins, pigments, fillers, and additives, for example, and processing the components by heating and milling, for example, whereupon a homogeneous mass is dispensed by an extruder. The mass is then cooled, crushed into small chips or lumps, and then ground into a powder.

The aforementioned additives incorporated within the powder particles can include one or more of charge agents for tribo-charging, flow aids for curing/fixing, cross-linkers to build up multiple chains, and catalysts to change the degree of cross-linking by initiating polymerization. Pigments can also be added to create a desired decorative effect. It is also contemplated to provide a powder in the form of a clear coat.

Use of commercial electrostatic powder paints in a rotating magnet powder paint applicator results in nonuniform and thick coatings, and considerable waste. The large particles (>100μ volume mean) associated with the electrostatic powders are low charging and so easily dust out of the applicator, or, due to their high mass, are ejected from the agitation of the rotating magnetic brush. If the brush speed is decreased to reduce dusting, coating efficiency is also diminished to an undesirable level. The large particle sizes of electrostatic spray powders also dictate the minimum thickness for complete substrate coverage; the minimum is roughly the radius of a representative particle.

Smaller particle sizes (<50μ) are preferred in a rotating magnet powder applicator to generate uniform coatings at the high substrate speeds characteristic of powder painting. Compared to printing operations, the amount of marking material (i.e, plastic or ink) used for powder painting can be well over an order of magnitude higher. Offset inking is usually <1μ in thickness, electrophotographic images are <10μ layer thickness, while powder painting commonly requires 50-100μ layer thicknesses for substrate protection. The thicker layers follow from the large particulates used in electrostatic spray coating; higher laydowns are necessary to ensure that a minimum coverage is realized.

Commercial powder paints can be utilized in rotating brush applicator systems by reprocessing the powder through low temperature extrusion and recompounding, and pulverization with addenda such as charge agents and surface treatment.

The components that make up the powder particles may be ground/pulverized to make a powder with a particle size ranging from 5 microns to 50 microns, not necessarily the same as the initial particle size. The invention is particularly useful with small powder particles having a diameter of less than 20 microns and, preferably, less than 12 microns, thereby resulting in coating layers that have fewer, or substantially no pinholes, after curing.

Electrographic printers typically employ a developer having two or more components, consisting of resinous, pigmented toner particles, magnetic carrier particles and other components. The developer is moved into proximity with an electrostatic image carried on an electrographic imaging member, whereupon the toner component of the developer is transferred to the imaging member, prior to being transferred to a sheet of paper to create the final image. Developer is moved into proximity with the imaging member by an electrically-biased, conductive toning shell, often a roller that may be rotated co-currently with the imaging member, such that the opposing surfaces of the imaging member and toning shell travel in the same direction. Located adjacent the toning shell is a multipole magnetic core, having a plurality of magnets, that may be fixed relative to the toning shell or that may rotate, usually in the opposite direction of the toning shell. The developer is deposited on the toning shell and the toning shell moves the developer into proximity with the imaging member, at a location where the imaging member and the toning shell are in closest proximity, referred to as the "toning nip."

As described in U.S. Pat. No. 6,228,549, conventionally, carrier particles made of soft magnetic materials have been employed to carry and deliver the toner particles to the electrostatic image. U.S. Pat. Nos. 4,546,060; 4,473,029; and 5,376,492; the teaching of which are incorporated herein by reference in their entirety, teach the use of hard magnetic materials as carrier particles and also the apparatus for the development of electrostatic images utilizing such hard magnetic carrier particle with a rotating magnet core applicator. These patents require that the carrier particles comprise a hard magnetic material exhibiting a coercivity of at least 300 Oesteds when magnetically saturated and an induced moment of at least 20 emu/g when in a field of 1000 Oesteds. The terms "hard" and "soft" when referring to magnetic materials have the generally accepted meaning as indicated on page 18 of "Introduction To Magnetic Materials" by B. D. Cullity published by Addison-Wesley Publishing Company 1972. These hard magnetic carrier particles represent a great advance over the use of soft magnetic carrier materials in the speed of development is remarkably increased with good image development.

Alternatively, the carrier particles can be used without coating, or with an appropriate polymeric coating.

Various resin materials can be employed as coatings on the hard magnetic carrier particles. Examples include those described in U.S. Pat. Nos. 3,795,617; 3,795,618; and 4,076,857; the teachings of which are incorporated herein by reference in their entirety. The choice of resin will depend upon its triboelectric relationship with the interned toner/powder. For use with toners which are desired to be positively charged, preferred resins for the carrier coating include fluorocarbon polymers such as poly(tetrafluoroethylene), poly(vinylidene fluoride) and ploy(vinylidene fluoride-co-tetrafluoroethylene). For use with toners which are desired to be negatively charged, preferred resins for the carrier include silicone resins, as well as mixtures of resins, such as a mixture of poly (vinylidene fluoride) and polymethylmethacryalte. Various polymers suitable for such coatings are also described in U.S. Pat. No. 5,512,403, the teaching of which are incorporated herein by reference in their entirety.

The carrier particles may also be semiconductive or conductive as described in U.S. Pat. Nos. 4,764,445; 4,855,206; 6,228,549; and 6,232,026; the teaching of which are incorporated herein by reference in their entirety.

The particle size of the carriers is less than 100μ volume average diameter, preferably from about 3 to 65μ and, more preferably, about 5 to 20μ. The carrier particles are then magnetized by subjecting them to an applied magnetic field of sufficient strength to yield magnetic hysteresis behavior.

Multiple toning stations can be used to produce a thick coating layer. If a first material is deposited in two or more layers by two or more magnetic brush applicators, banding can occur. To counteract this artifact, a phase relationship between the rotating cores can be maintained, so that, if magnetic pole transitions of upstream development stations produce banding in the image, the rotating core of downstream stations fill in the light bands in the image. The phase relationship may be maintained by gearing, with a differential for adjusting the phase of each roller relative to the other manually or automatically. It may also be maintained by individual electric motors for each magnetic core. Using sensors, such as optical density detectors or video cameras, a process control loop can be implemented to maintain a phase relationship between a first magnetic brush and a second magnetic brush so that a uniform coating free of banding is obtained.

Although the magnetic brush with a rotating core will typically be used with the shell rotating cocurrent with the receiver and the core rotating countercurrent to the direction of travel of the receiver, in certain situations it may be advantageous to utilize the shell rotating cocurrent with the receiver, countercurrent with the receiver, slowly moving in either direction or stationary, and either direction of core rotation.

Figure 2:
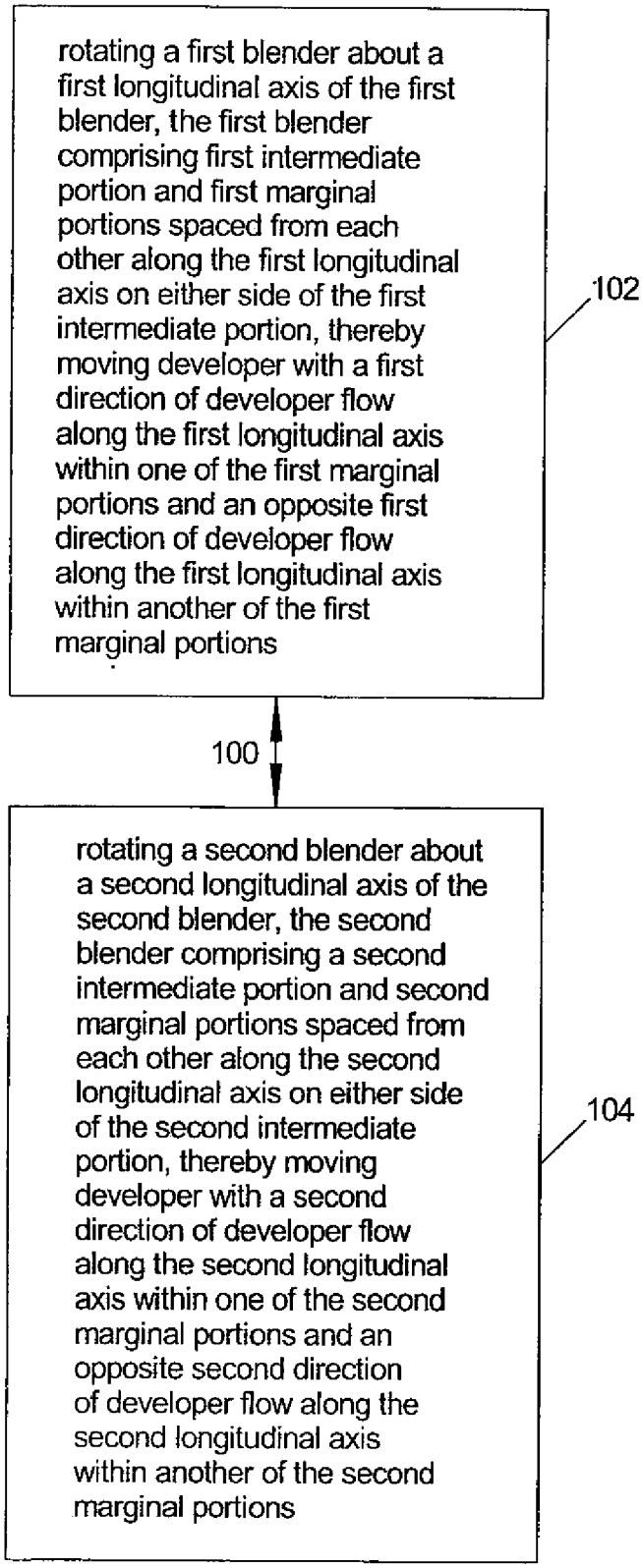
FIG. 2 is a schematic representation of a process according to one aspect of the invention.

Referring now to FIG. 2, an electrographic mixing process 100 is presented according to one aspect of the invention. The electrographic mixing process 100 comprises rotating a first blender about a first longitudinal axis of the first blender, the first blender including a first intermediate portion and first marginal portions spaced from each other along the first longitudinal axis on either side of the first intermediate portion, thereby moving developer with a first direction of developer flow along the first longitudinal axis within one of the first marginal portions and an opposite first direction of developer flow along the first longitudinal axis within another of the first marginal portions, as indicated by 102. The process 100 also comprises rotating a second blender about a second longitudinal axis of the second blender, the second blender including a second intermediate portion and second marginal portions spaced from each other along the second longitudinal axis on either side of the second intermediate portion, thereby moving developer with a second direction of developer flow along the second longitudinal axis within one of the second marginal portions and an opposite second direction of developer flow along the second longitudinal axis within another of the second marginal portions, as indicated by 104.

Figure 3:
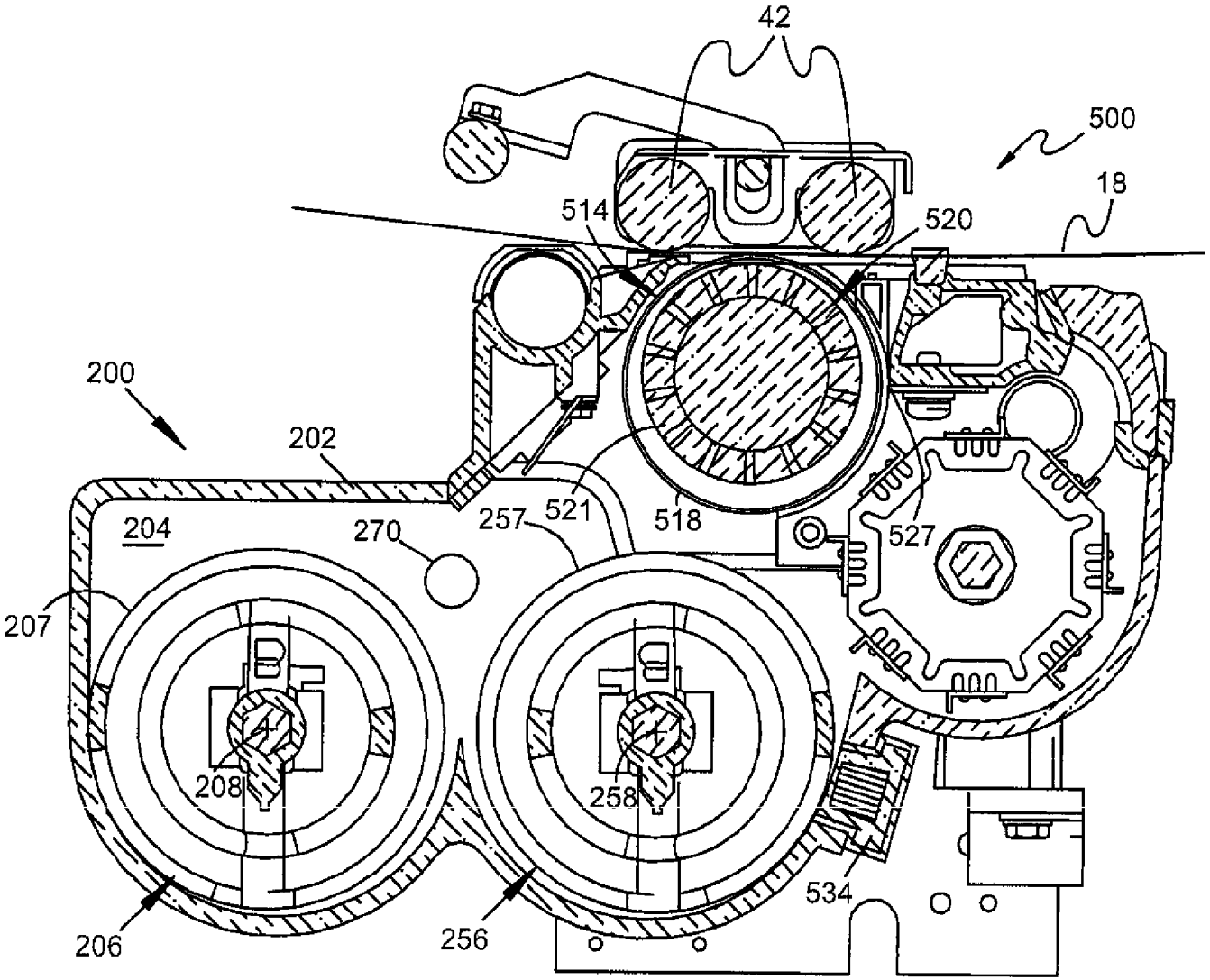
FIG. 3 is a cross-sectional side view of an electrographic developer mixing apparatus, according to one aspect of the invention, implemented as part of a development station.
Figure 4A:
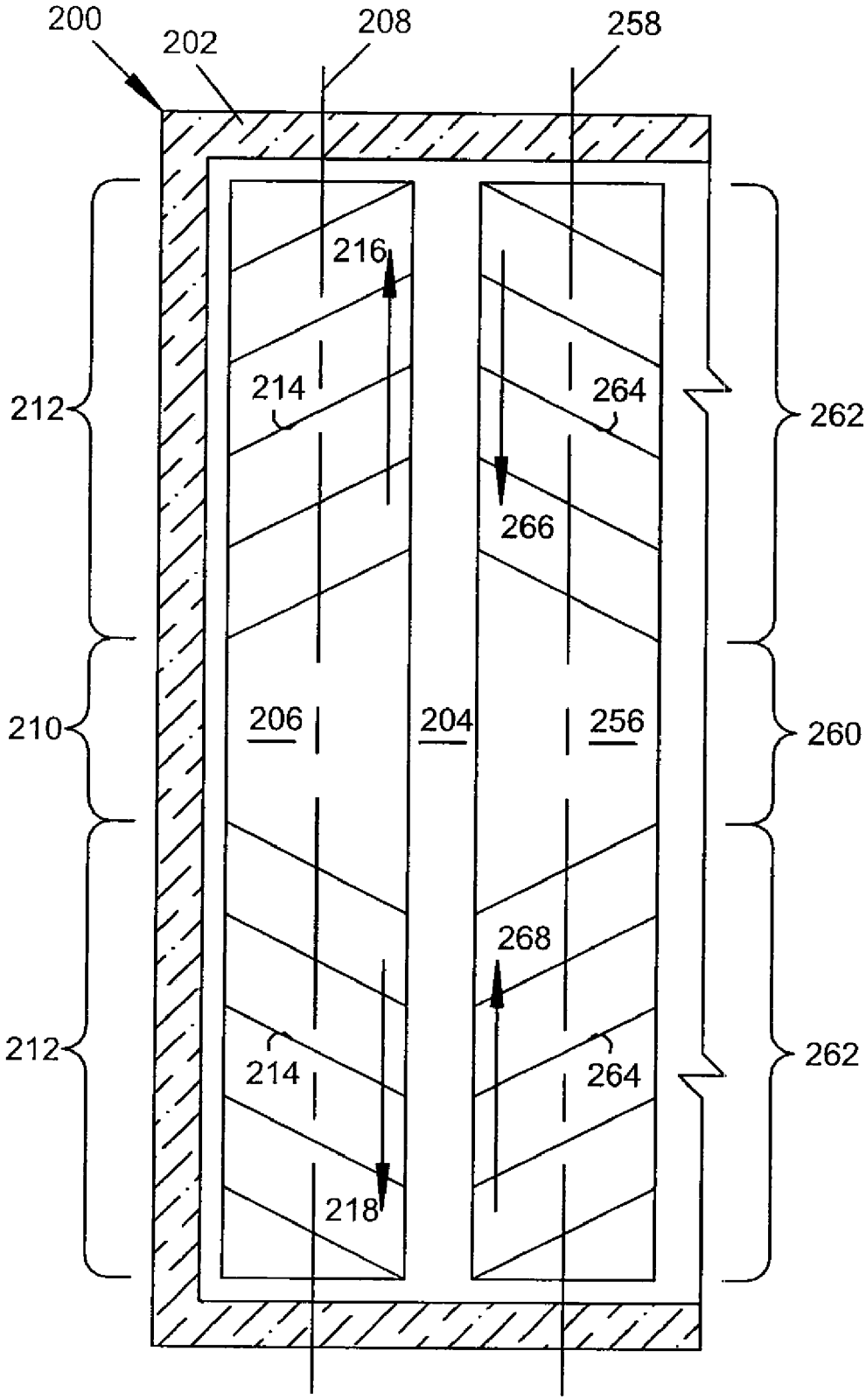
FIGS. 4*a*-4*d* are cross-sectional top views of embodiments of the FIG. 3 apparatus with parts broken away.

Referring now to FIGS. 3 and 4*a*, an electrographic developer mixing apparatus 200 is presented, according to one aspect of the invention, as part of an electrographic development station 500. The apparatus 200 comprises a housing 202 that comprises a chamber 204 that holds developer (not shown for the sake of clarity). A first blender 206 is disposed within the chamber 204 and is elongate along a first longitudinal axis 208. The first blender 206 comprises a first intermediate portion 210 and first marginal portions 212 spaced from each other along the longitudinal axis 208 on either side of the first intermediate portion 210. The first marginal portions 212 comprise first elements 214 that, upon rotation about the first longitudinal axis 208, move developer with a first direction 216 of developer flow along the longitudinal axis 208 within one of the first marginal portions 212 and an opposite first direction 218 of developer flow along the first longitudinal axis 208 within the other of the first marginal portion 212. A second blender 256 is disposed within the chamber 204, adjacent the first blender 206, and is elongate along a second longitudinal axis 258. The second blender 256 comprises a second intermediate portion 260 and second marginal portions 262 spaced from each other along the longitudinal axis 258 on either side of the second intermediate portion 260. The second marginal portions 262 comprise second elements 264 that, upon rotation about the second longitudinal axis 258, move developer with a second direction 266 of developer flow along the longitudinal axis 258 within one of the second marginal portions 262 and an opposite second direction 268 of developer flow along the second longitudinal axis 258 within the other of the second marginal portion 262. A toner replenisher 270 may be provided, as is well known the art that replenishes toner intermediate the first blender 206 and the second blender 256.

In one embodiment the first elements 214 may include continuous helical ribbons or helical ribbon segments and the second elements 264 may include paddles, blades, augers, and/or ribbon elements, propellers and the like. Examples of the structure of some types of elements are disclosed in U. S. Pat. Nos. 4,634,286; and 6,585,406; the contents of which are hereby incorporated by reference as if fully set forth herein.

As shown in FIG. 4*a*, the first direction 216 may be oriented opposite the second direction 266. For example, the first direction 216 may be oriented from the first intermediate portion 210 to the first marginal portions 212, and the second direction 266 may be oriented from the second marginal portions 262 to the second intermediate portion 260. Of course, these orientations could easily be reversed if so desired. Numerous combinations are possible in the practice of the invention. The first direction 216 may also be adjacent to an outer periphery 207 of the first blender 206, and/or the second direction 266 may be adjacent to an outer periphery 257 of the second blender 256. Desired flow direction orientations may be achieved by changing the geometry of the blenders. Desired flow direction orientations may also be achieved by changing rotation direction, for example with identical blenders. Flow direction may be reversed with a given blender merely by rotating the blender 180° about an axis perpendicular to the longitudinal axis. All such variations are considered to fall within the purview of the invention. Rotation of the blenders is implemented using gears, pulleys, chains, belts, direct drive, variable drive etc. using a motor disposed on the outside of the housing attached to the shafts of the blenders. These orientations could be easily reversed, if desired, in this and the other embodiments described below.

Figure 4B:
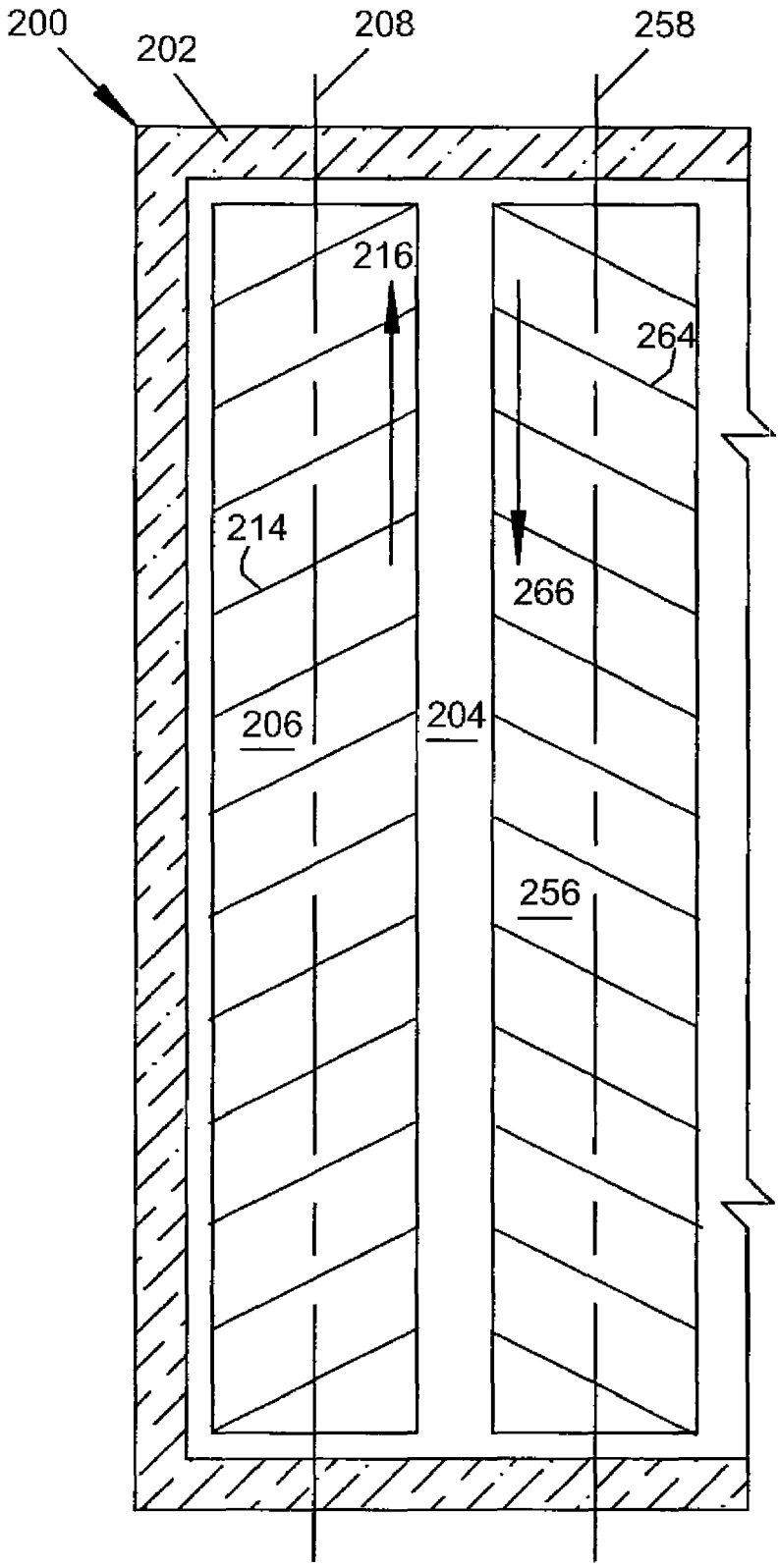

In another embodiment shown in FIG. 4*b*, the first direction 216 may be oriented opposite the second direction 266. For example, the first direction 216 may be oriented the length of the first blender 206, and the second direction 266 may be oriented the length of the second blender 256.

Figure 4C:
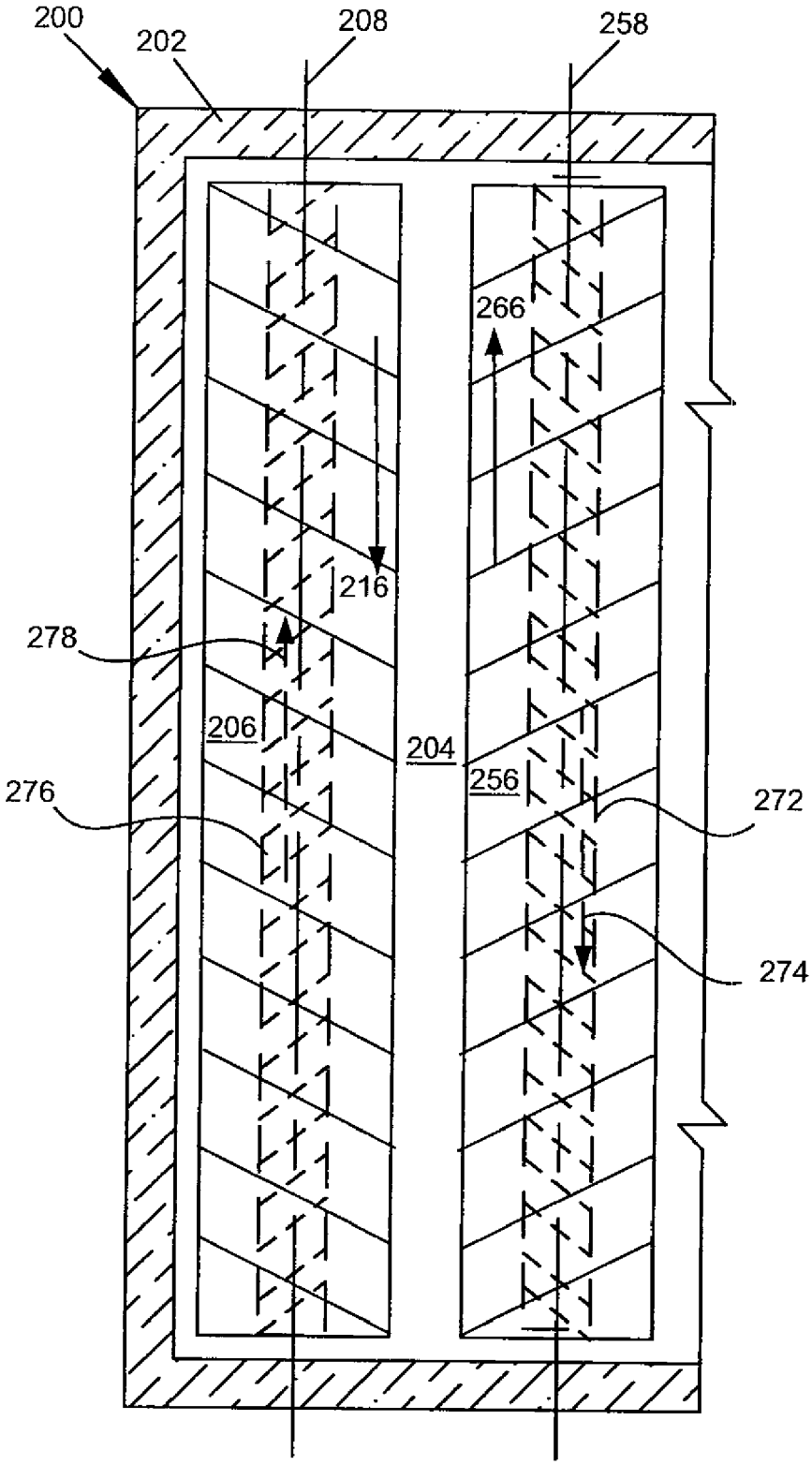

In another embodiment shown in FIG. 4*c*, the first direction 216 may be oriented opposite the second direction 266. For example, the first direction 216 may be oriented the length of the first blender 206, and the second direction 266 may be oriented the length of the second blender 256. Of course, these orientations could easily be reversed if so desired. In addition, an inner blender 272 with a flow direction indicated by arrow 274 is disposed within second blender 256. An inner blender 276 with a flow direction indicated by arrow 278 is disposed within first blender 206.

Figure 4D:
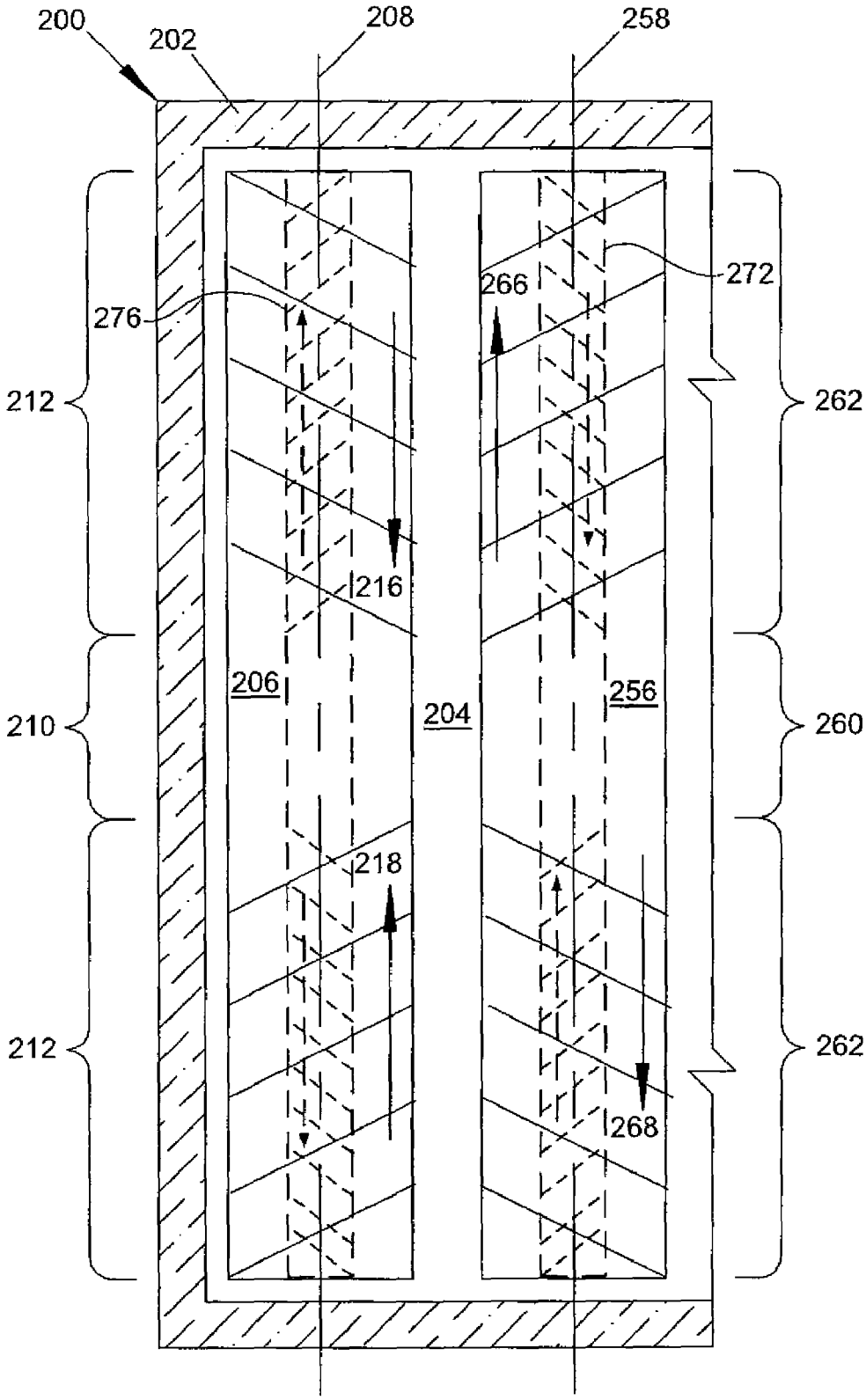

In another embodiment shown in FIG. 4*d*, the second blender 256 has flow directions 266, 268 oriented from the second intermediate portion 260 to the second marginal portions 262. First blender 206 has flow directions 216, 218 oriented from first marginal portions 212 to the first intermediate portion 210. In addition, an inner blender 272 is disposed within second blender 256 and has a flow direction oriented from second marginal portions 262 towards second intermediate portion 260. In this case, as in all the above examples, there could be an outlet, open portion or diverter, shown as a plow 442 in FIG. 7, in the second intermediate portion 260. The open portion and/or diverter would allow the two converging flows be diverted without clogging. An inner blender 276 is disposed within first blender 206 and has flow directions from first intermediate portion 210 to the first marginal portions 212. The inner blender or elements thereof can be controlled by a variable speed device 280 that allows the elements of the one blender to move at a different speed relative to another blender. One skilled in the art would understand that one or, more of either blender could be similarly controlled, as could the separate marginal portions of the blender. It is also known by one skilled in the art how to make and use a variable speed device that could be used to control one or more blender.

Figure 5:
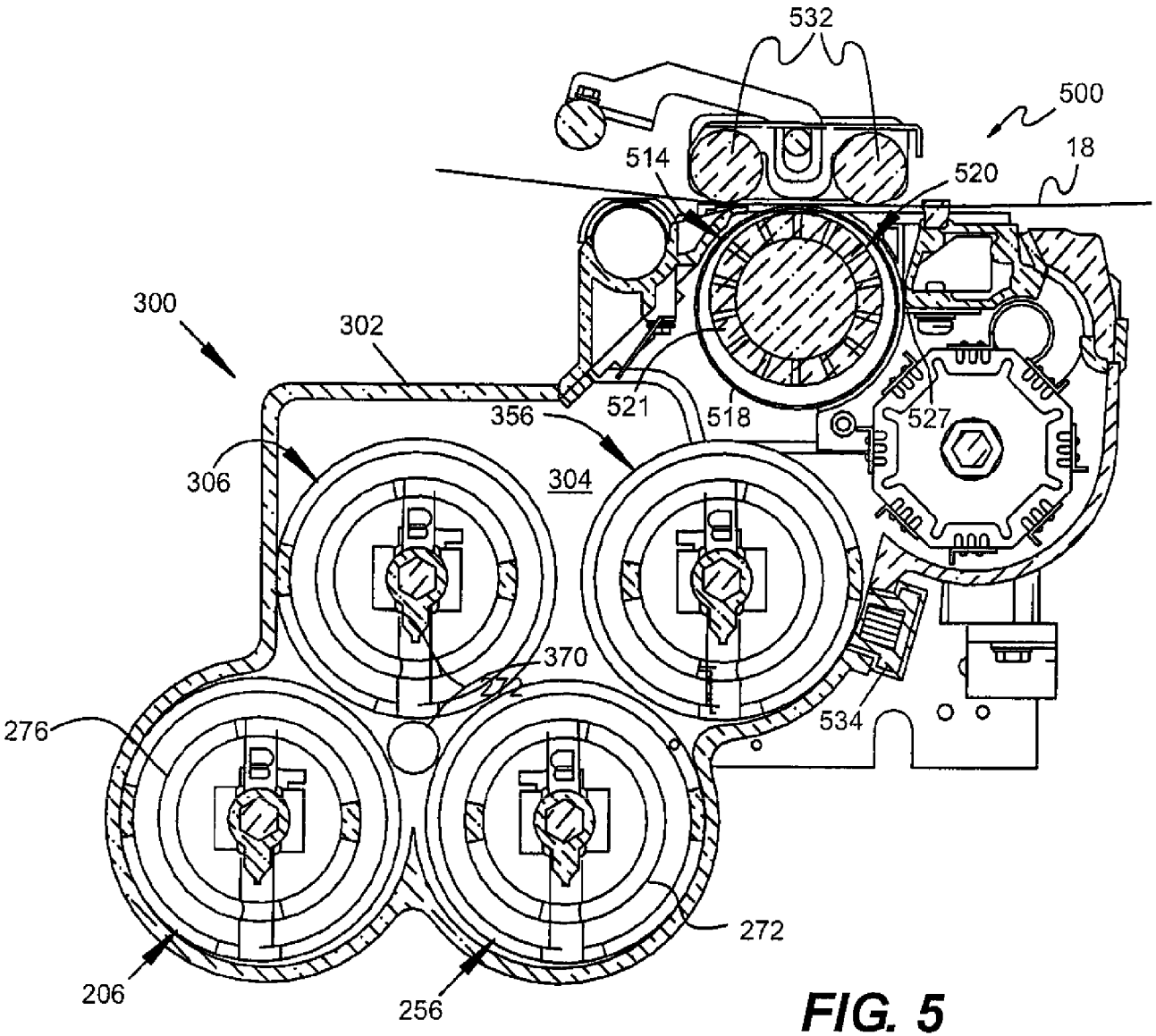
FIG. 5 is a cross-sectional side view of an electrographic developer mixing apparatus, according to a further aspect of the invention, implemented as part of a development station.

Referring now to FIG. 5, an electrographic developer mixing apparatus 300 is presented, according to another aspect of the invention, as part of the electrographic development station 500. The apparatus 300 comprises a housing 302 including a chamber 304. In addition to the first blender 206, inner blender 276, the second blender 256 and inner blender 272, a third blender 306 is disposed within the chamber 304 adjacent at least one of the first blender 206 and the second blender 256. More specifically, the third blender 306 may be disposed adjacent the first blender 206 and the second blender 256. Likewise, a fourth blender 356 may be disposed within the chamber 304 adjacent at least one of the first blender 206, the second blender 256, and the third blender 306. Again, more specifically, the third blender 306 may be adjacent the first blender 206, the fourth blender 356 may be adjacent the second blender 256, and the third blender 306, may be adjacent the fourth blender 356. The third blender 306 and the fourth blender 356 may be configured and operated as previously described with respect to the first blender 206 and the second blender 256.

Toner may be replenished in a space between blenders. For example, intermediate the first blender 206, the second blender 256, and the third blender 306. A toner replenisher 370 of known configuration may be inserted into the space between these blenders for this purpose. One example of a suitable replenisher is a tube having a wire brush feeder, that may be an auger-type feeder, inside that feeds toner from a hopper.

The development station 500 of FIGS. 3 and 5 is exemplary only. In the example presented in those figures, the electrographic imaging member 18 passes over a magnetic brush 514 including a rotating toning shell 518, a mixture of carriers and toner (also referred to herein as "developer"), and a magnetic core 520. In a preferred embodiment, the magnetic core 520 comprises a plurality of magnets 521 of alternating polarity, located inside the toning shell 518. Magnetic Core 520 may be stationary or rotate, either in the same or opposite direction of toning shell rotation, causing the magnetic field vector to rotate in space relative to the plane of the toning shell. Alternative arrangements are possible, however, such as an array of fixed magnets or a series of solenoids or similar devices for producing a magnetic field. An exemplary imaging member 18 is a photoconductor and is configured as a sheet-like film. However, the imaging member may be another type substrate configured in other ways, such as a drum or as another material and configuration capable of retaining an electrostatic image, used in electrophotographic, ionographic or similar applications. The film imaging member 18 is relatively resilient, typically under tension, and a pair of backer bars 532 may be provided that hold the imaging member in a desired position relative to the toning shell 518. A metering skive 527 may be moved closer to or further away from the toning shell 518 to adjust the amount of developer delivered. One or more toner monitors 534 may be provided that measure an amount of toner in the developer.

Another exemplary arrangement is to deposit powder directly onto a substrate without the use of a photoconductive or ionographic imaging member 18, or to deposit powder onto an intermediate and then onto a substrate.

Figure 6:
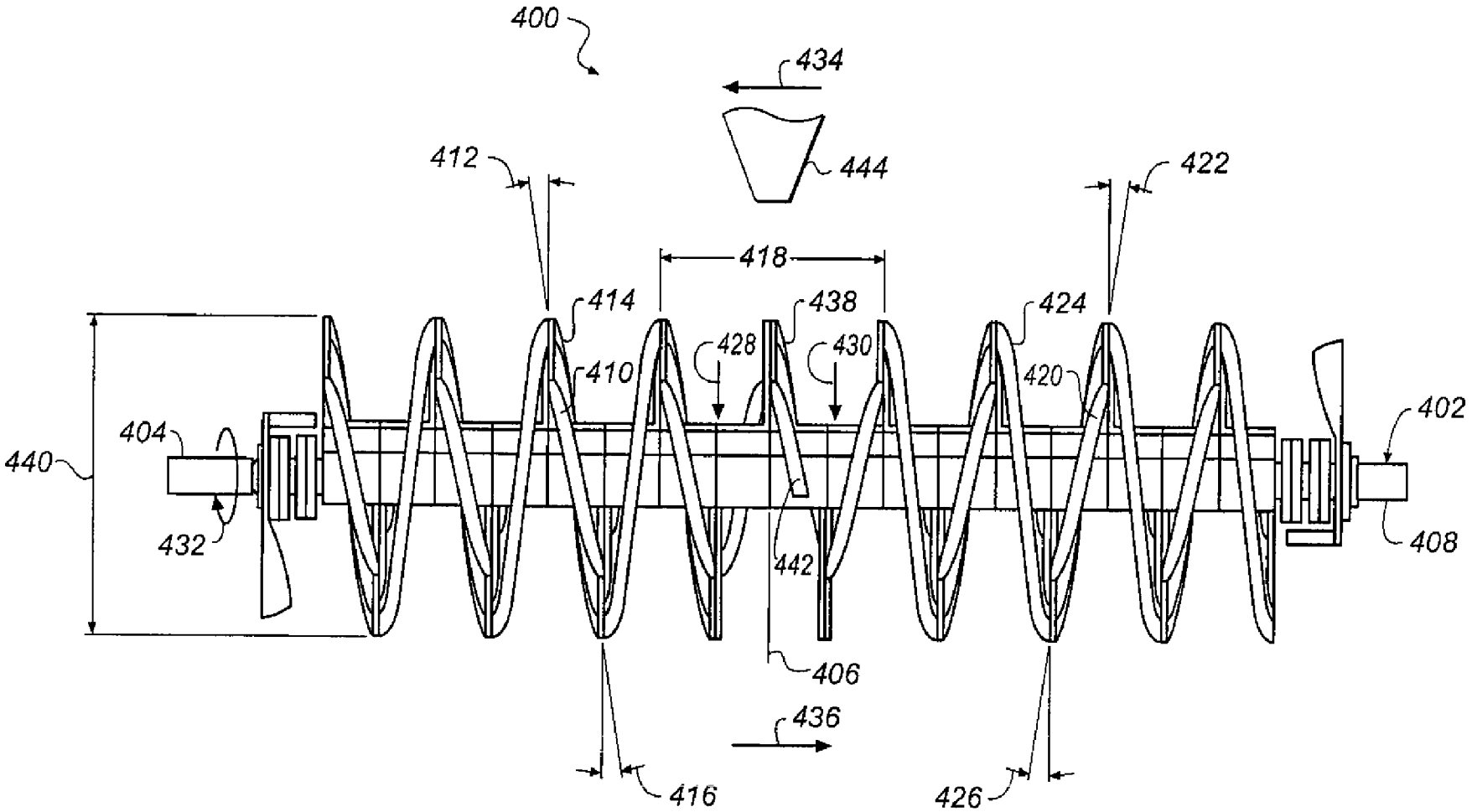
FIG. 6 presents a side view of a blender according to an aspect of the invention.

Referring now to FIG. 6, a blender 400 for mixing electrographic developer is presented, according to an aspect of the invention. Blender 400 comprises an elongate shaft 402 having two ends 404 and 408 and an intermediate location 406 between the two ends 404 and 408. An inner helical ribbon 410 is mounted concentrically to the elongate shaft 402 for rotation therewith and having a pitch 412. An outer helical ribbon 414 is mounted concentrically to the elongate shaft 402 for rotation therewith and has an opposite pitch 416 relative to the pitch 412. The inner helical ribbon 410 is disposed within the outer helical ribbon 414.

Another inner helical ribbon 420 is mounted to the elongate shaft 402 for rotation therewith adjacent to the inner helical ribbon 410 and has pitch 422. Another outer helical ribbon 424 is mounted to the elongate shaft 402 for rotation therewith adjacent to the outer helical ribbon 414 and has another opposite pitch 426 relative to the another pitch 422. The another inner helical ribbon 420 is disposed within the another outer helical ribbon 424.

The outer helical ribbon 414 and the another outer helical ribbon 424 are terminated to provide an opening 418 spanning the intermediate location 406 through which developer is drawn into said inner helical ribbon 410 and the another inner helical ribbon 420 (indicated by arrows 428 and 430) upon rotation of the longitudinal shaft (indicated by arrow 432).

The pitch 412 and the another opposite pitch 426 are in a same direction 434 relative to the elongate shaft 402. The another pitch 422 and the opposite pitch 416 are in another same direction 436 opposite to the same direction 434. The magnitudes of the various pitches may or may not be the same. According to a preferred embodiment, the magnitudes of pitches 412 and 422 are equal, and the magnitudes of pitches 416 and 426 are equal.

In FIG. 6, at 438, the another inner helical ribbon 420 transitions to the outer helical ribbon diameter 440 of the outer helical ribbons ribbon 414 and 424. This is completely optional. Alternatively, the inner helical ribbon 410 could just as easily transition to the outer helical ribbon diameter 440. Therefore, according to a further aspect of the invention, blender 400 may comprise one of the inner helical ribbon 410 transitioning to the outer helical ribbon diameter 440 and the another inner helical ribbon 420 transitioning to said outer helical ribbon diameter 440.

Furthermore, at 442, inner helical ribbon 410 partially transitions to the outer helical ribbon diameter 440. The another inner helical ribbon could be configured in like manner. Regardless, at least one of the inner helical ribbon 410 and the another helical ribbon 420 may be configured in such manner. Therefore, according to a further aspect of the invention, the blender 400 may comprise at least one of the inner helical ribbon 410 partially transitioning to the outer helical ribbon diameter 440 and the another inner helical ribbon 420 partially transitioning to the outer helical ribbon diameter 440.

The blender 400 of FIG. 6 may be fabricated from the blender of FIGS. 7-14 of U.S. Pat. No. 6,585,406 entitled Electrostatographic Blender Assembly and Method, issued Jul. 1, 2003, the contents of which are fully incorporated by reference as if set forth herein, by cutting unwanted sections of the helical ribbons away. Any method of cutting is suitable, for example with hand operated dikes.

Figure 7:
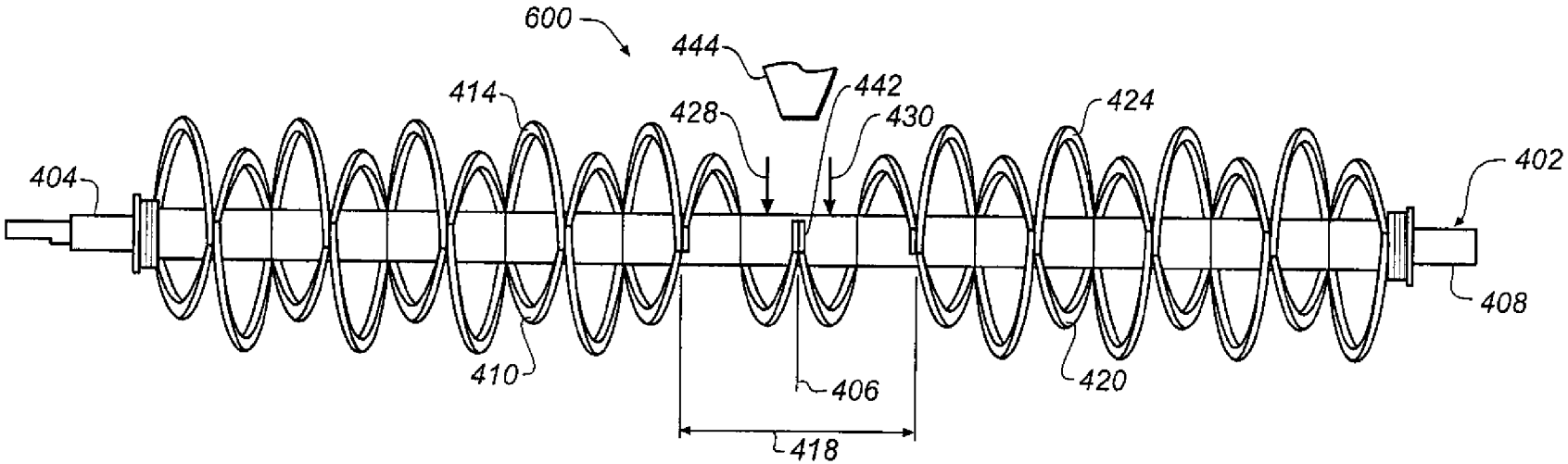
FIG. 7 presents a perspective view of the FIG. 6 blender.
Figure 8:
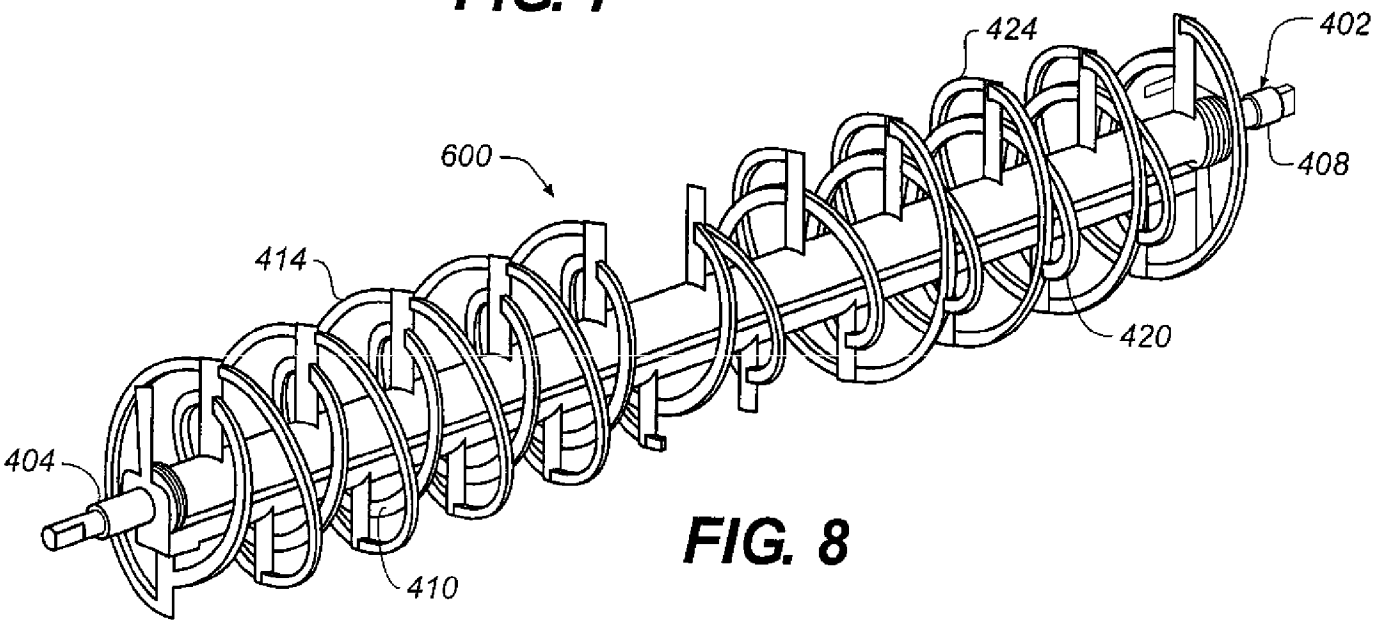
FIG. 8 presents a cross-sectional view of an electrographic developer mixing apparatus according to an aspect of the invention.

Referring now to FIGS. 7 and 8, a blender 600 generally similar to blender 400 is presented. As shown in FIGS. 7 and 8, the inner helical ribbon 410 and another inner helical ribbon 420 may terminate at the intermediate location 406. The inner helical ribbon 410 and another inner helical ribbon 420 may meet at the intermediate location, and may form a plow 442. The inner helical ribbon 410 and the another inner helical ribbon 420 may not meet at the intermediate location 406, however.

The blender 400 and 600 generally provides a flow pattern of developer as described in U.S. Pat. No. 4,634,286 entitled Electrographic Development Apparatus Having a Continuous Coil Ribbon Blender, issued Jan. 6, 1987, and particularly FIG. 3 thereof. The helical ribbons 414, 424, 410 and 420 may be continuous or piecewise continuous, as described in U.S. Pat. Nos. 4,610,068; 4,887,132; 4,956,675; 5,146,277; 4,634,286; 6,585,406; and similar structures as may be expedient.

According to a further aspect of the invention, a method for mixing electrographic developer is provided, comprising rotating an elongate shaft 402 having two ends 404 and 408 and an intermediate location 406 between the two ends 404 and 408, moving developer with an inner helical ribbon 410 mounted concentrically to the elongate shaft 402 for rotation therewith and having a pitch 412, moving developer with an outer helical ribbon 414 mounted concentrically to the elongate shaft 402 for rotation therewith and having an opposite pitch 416 relative to the pitch 412, the inner helical ribbon being disposed within the outer helical ribbon, moving developer with another inner helical ribbon 420 mounted to the elongate shaft 402 for rotation therewith adjacent to the inner helical ribbon 410 and having another pitch 422, moving developer with another outer helical ribbon 424 mounted to the elongate shaft 402 for rotation therewith adjacent to the outer helical ribbon 414 and having another opposite pitch 426 relative to the other pitch 416, the another inner helical ribbon 420 being disposed within the another outer helical ribbon 424, the outer helical ribbon 414 and the another outer helical ribbon 424 being terminated to provide an opening 418 spanning the intermediate location 406 through which developer is drawn into the inner helical ribbon 410 and the another inner helical ribbon 420 upon rotation of the elongate longitudinal shaft 402.

According to a further aspect of the invention, a method is provided for mixing electrographic developer, comprising rotating an elongate shaft 402 having two ends 404 and 408 and an intermediate location 406 between the two ends 404 and 408, moving developer away from the intermediate location 406 toward one of the ends 404 with an inner helical ribbon 410 mounted concentrically to the elongate shaft 402 for rotation therewith, moving developer away from the one of the ends 404 toward the intermediate location 406 with an outer helical ribbon 414 mounted concentrically to the elongate shaft 402 for rotation therewith, the inner helical ribbon 410 being disposed within the outer helical ribbon 414, moving developer away from the intermediate location 406 toward another of the ends 408 with another inner helical ribbon 420 mounted to the elongate shaft 402 for rotation therewith, moving developer away from the another of the ends 408 toward the intermediate location 406 with another outer helical ribbon 424 mounted to the elongate shaft 402 for rotation therewith, the another inner helical ribbon 420 being disposed within the another outer helical ribbon 424, the outer helical ribbon 414 and the another outer helical ribbon 424 being terminated to provide an opening 418 spanning the intermediate location 406 through which developer is drawn into the inner helical ribbon 410 and the another inner helical ribbon 420 upon rotation of the elongate shaft 402.

The invention preferably comprises adding toner to the developer proximate the intermediate location 406, for example by a toner replenisher 444. As used herein, the term "proximate the intermediate location" means that the toner is preferentially drawn into the inner helical ribbon 410 and the another inner helical ribbon 420 through the opening 418. This greatly improves homogeneity of toner concentration in the developer mix and resulting homogeneity of toner density of a developed electrostatic image on an electrographic substrate, film, media, or belt. The invention has been found to eliminate a strip of greater toner density in the center section of a developed electrostatic image.

Mixing elements comprise moving, usually rotating, mechanical components that mix materials, such as: augers, beaters, screws, rotors, propellers, paddles, turrets, wheels, plow blenders or ribbon blenders, and the like. A ribbon blender includes helical or spiral portions spaced radially from a central axis, with at least one open area between the ribbon and the axis. Another type of mixing element, as discussed above, is the auger which is a helical or spiral mixing element comprising a solid screw.

Ribbon blenders, augers, and planetary mixers are further described in "Polymer Mixing and Extrusion Technology" by Nicholas P. Cheremisinoff, Marcel Dekker, Inc., Copyright 1987 by Marcel Dekker, Inc., and "Perry's Chemical Engineers' Handbook" Seventh Edition, Copyright 1997 The McGraw-Hill Companies, Inc., the contents of which are hereby incorporated herein by reference.

Figure 9:
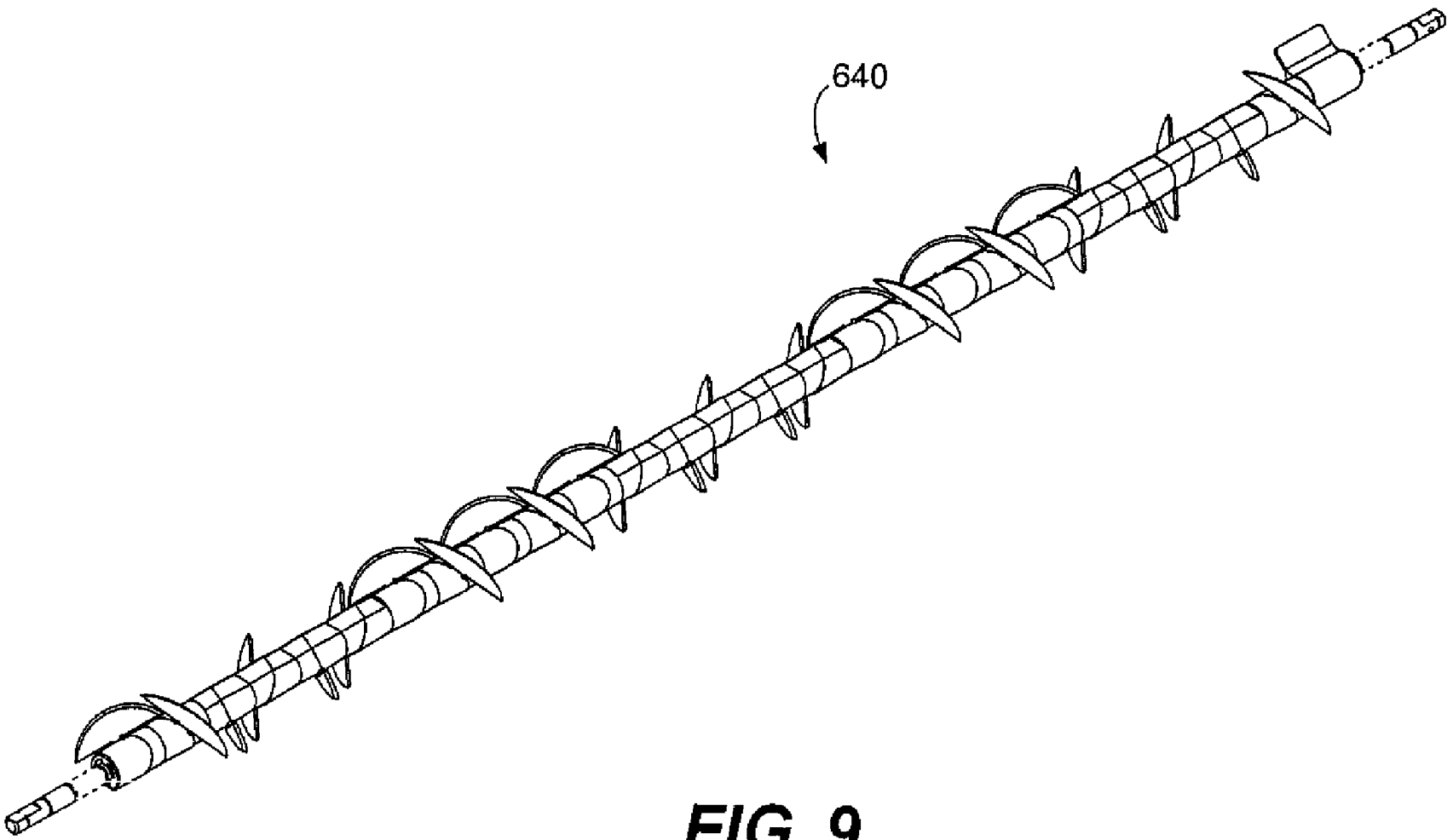
FIG. 9 presents a perspective view of a blender according to an aspect of the invention.

FIG. 9 presents a perspective view of a blender 640 according to an aspect of the invention, comprising an elongate shaft having two ends with an inner portion having blades and an outer helical ribbon blender mounted concentrically to the elongate shaft, the inner portion being disposed within the outer helical ribbon. The inner portion and outer helical ribbon may move developer in the same or opposite directions.

The processes of the present invention may also include a powder applicator for applying powder materials in conjunction with an electrographic apparatus. It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. While various elements may have been described as being implemented by software, in other embodiments hardware or firmware implementations may alternatively be used, and vice-versa. Similarly, the controllers may implement software, hardware, and/or firmware. In view of the wide variety of embodiments to which the principles of the present invention can be applied, it should be understood that the illustrated embodiments are exemplary only, and should not be taken as limiting the scope of the present invention.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

The invention claimed is:

1. A developer mixing apparatus, comprising: a housing enclosing a chamber that holds developer; a first ribbon blender disposed within the chamber and elongate along a first longitudinal axis, the first ribbon blender including a first intermediate portion and first marginal portions spaced from each other along the longitudinal axis on either side of the first intermediate portion, the first marginal portions including first elements that, upon rotation about the first longitudinal axis, move developer with a first direction of developer flow along the first longitudinal axis within one of the first marginal portions and an opposite first direction of developer flow along the first longitudinal axis within another of the first marginal portions; a second ribbon blender disposed within the chamber and elongate along a second longitudinal axis and adjacent the first ribbon blender, the second ribbon blender including a second intermediate portion and second marginal portions spaced from each other along the second longitudinal axis on either side of the second intermediate portion, the second marginal portions including second elements that, upon rotation about the second longitudinal axis, move developer with a second direction of developer flow along the second longitudinal axis within one of the second marginal portions and an opposite second direction of developer flow along the second longitudinal axis within another of the second marginal portions; a third ribbon blender disposed within the chamber and elongate along a third longitudinal axis and adjacent at least one of the first ribbon blender and the second ribbon blender; and a fourth ribbon blender disposed within the chamber and elongate along a fourth longitudinal axis and adjacent at least one of the first ribbon blender, the second ribbon blender, and the third ribbon blender.

2. The apparatus of claim 1 wherein: the third ribbon blender is adjacent the first ribbon blender; the fourth ribbon blender is adjacent the second ribbon blender; and the third ribbon blender, is adjacent the fourth ribbon blender.

3. The apparatus of claim 2 wherein: a toner replenisher is disposed intermediate the first ribbon blender, the second ribbon blender, the third ribbon blender and the fourth ribbon blender.

4. The apparatus of claim 1 further including: a toner replenisher disposed intermediate the first ribbon blender, the second ribbon blender, and the third ribbon blender.

* * * * *